US011165139B1

(12) United States Patent
Paulotto et al.

(10) Patent No.: US 11,165,139 B1
(45) Date of Patent: Nov. 2, 2021

(54) ELECTRONIC DEVICES HAVING ANTENNAS THAT RADIATE THROUGH A DISPLAY

(71) Applicant: Apple Inc., Cupertino, CA (US)

(72) Inventors: Simone Paulotto, Redwood City, CA (US); Matthew A. Mow, Los Altos, CA (US); Mattia Pascolini, San Francisco, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 16/920,312

(22) Filed: Jul. 2, 2020

Related U.S. Application Data

(62) Division of application No. 15/884,245, filed on Jan. 30, 2018, now Pat. No. 10,727,570.

(51) Int. Cl.
*H01Q 1/24* (2006.01)

(52) U.S. Cl.
CPC ..... *H01Q 1/243* (2013.01)

(58) Field of Classification Search
CPC ..... H01Q 1/243; H04B 1/03; H04B 1/0475
See application file for complete search history.

(56) References Cited

U.S. PATENT DOCUMENTS 9,075,199 B2 7/2015 Jiao et al.
9,178,268 B2 11/2015 Zhu et al.
9,214,507 B2 12/2015 Mathew et al.
9,488,862 B2 11/2016 Doyle et al.
9,543,364 B2 1/2017 Rappoport et al.
9,839,144 B2 12/2017 Chuang et al.
2014/0049721 A1* 2/2014 Huang ..... G02F 1/136204 349/59
2016/0308563 A1 10/2016 Ouyang et al.
2016/0336643 A1 11/2016 Pascolini et al.
2017/0309988 A1 10/2017 Samardzija et al.
2017/0309991 A1 10/2017 Noori et al.
(Continued)

OTHER PUBLICATIONS

Hong et al., "Optically Invisible Antenna Integrated Within an OLED Touch Display Panel for IoT Application" IEEE Transactions on Antennas and Propagation, vol. 65, Issue: 7, Jul. 2017, 6 pages. <http://ieeexplore.ieee.org/document/7930480/>.
(Continued)

*Primary Examiner* — Nguyen T Vo
(74) *Attorney, Agent, or Firm* — Treyz Law Group, P.C.; Michael H. Lyons

(57) ABSTRACT

An electronic device may be provided with a display and a phased array antenna that transmits radio-frequency signals at frequencies greater than 10 GHz. The display may include a conductive layer that is used to form pixel circuitry and/or touch sensor electrodes. A filter may be formed from conductive structures within the conductive layer. The conductive structures may include an array of conductive patches separated by slots or may include conductive paths that define an array of slots. The filter may include an additional array of conductive patches stacked under the array of conductive patches to allow the slots to be narrower than would be resolvable to the unaided human eye. The periodicity of the conductive structures and the slots in the filter may be selected to tune a cutoff frequency of the filter to be greater than frequencies handled by the phased antenna array.

20 Claims, 13 Drawing Sheets

(56) References Cited

U.S. PATENT DOCUMENTS

| | | | | |
|---|---|---|---|---|
| 2017/0309992 | A1 | 10/2017 | Noori et al. | |
| 2017/0309995 | A1 | 10/2017 | Kim et al. | |
| 2018/0026341 | A1 | 1/2018 | Mow et al. | |
| 2018/0190601 | A1* | 7/2018 | Hitomi | H03F 3/245 |
| 2019/0198979 | A1 | 6/2019 | Cao et al. | |

OTHER PUBLICATIONS

Kaipa et al., "Transmission Through Stacked 2D Periodic Distributions of Square Conducting Patches", Journal of Applied Physics 112, 033101, Aug. 1, 2012, doi:10.1063/1.4740054, American Institute of Physics. <http://dx.doi.org/10.1063/1.4740054>.

Wikipedia contributors, 'Frequency Selective Surface', Wikipedia, The Free Encyclopedia, Jan. 12, 2018, 07:25 UTC. [accessed Apr. 25, 2018] <https://en.wikipedia.org/w/index.php?title=Frequency_selective_surface&oldid=819961436>.

* cited by examiner

ELECTRONIC DEVICES HAVING ANTENNAS THAT RADIATE THROUGH A DISPLAY

This application is a division of U.S. patent application Ser. No. 15/884,245, filed Jan. 30, 2018, which is hereby incorporated by reference herein in its entirety.

BACKGROUND

This relates generally to electronic devices and, more particularly, to electronic devices with wireless communications circuitry and display structures.

Electronic devices often include wireless communications circuitry. For example, cellular telephones, computers, and other devices often contain antennas and wireless transceivers for supporting wireless communications. Electronic devices often include display structures such as one or more displays for displaying image data or video data to a user.

It may be desirable to support wireless communications in millimeter wave and centimeter wave communications bands. Millimeter wave communications, which are sometimes referred to as extremely high frequency (EHF) communications, and centimeter wave communications involve communications at frequencies of about 10-300 GHz. Operation at these frequencies may support high bandwidths, but may raise significant challenges. For example, millimeter wave communications signals generated by antennas can be characterized by substantial attenuation and/or distortion during signal propagation through various mediums. In addition, if care is not taken, conductive structures within the electronic device such as conductive structures in a display may block millimeter wave communications in certain directions.

It would therefore be desirable to be able to provide electronic devices with improved wireless communications capabilities for supporting communications at frequencies greater than 10 GHz.

SUMMARY

An electronic device may be provided with wireless circuitry. The wireless circuitry may include antennas arranged in an array to form a phased array antenna and may include transceiver circuitry such as centimeter and millimeter wave transceiver circuitry (e.g., circuitry that transmits and receives radio-frequency signals at frequencies greater than 10 GHz).

The electronic device may include a touch screen display for displaying images and gathering touch input. The touch screen display may include a transparent display cover layer and a display module. The display module may include pixel circuitry that emits light through the display cover layer and touch sensor electrodes that receive touch input through the display cover layer. The display module may include a conductive layer that is used to form the pixel circuitry and/or the touch sensor electrodes.

A filter (e.g., a spatial filter such as a frequency selective surface) may be formed from conductive structures within the conductive layer. The conductive structures in the filter may include an array of conductive patches separated by slots in the conductive layer or may include inductive paths that define an array of slots in the conductive layer. If desired, the filter may also include an additional array of conductive patches in an additional conductive layer that are aligned with (e.g., stacked under) the array of conductive patches in the conductive layer. Stacking multiple arrays of conductive patches in the filter may allow the slots in the conductive layer to be reduced in size to below what is resolvable by the unaided human eye at a typical viewing distance from the display.

The filter may be configured to form a low pass filter. The periodicity of the conductive structures and the slots in the filter may be selected to be non-resonant (at the frequency of operation of the phased array antenna) and so that a cutoff frequency of the filter is greater than a frequency band handled by the phased array antenna (e.g., a frequency band including frequencies between 10 GHz and 300 GHz such as millimeter wave frequencies). The display module may include a radio-frequency opaque region that laterally surrounds the filter and that blocks (e.g., substantially or completely attenuates) electromagnetic signals in the frequency band handled by the phased array antenna. The filter may be transparent to electromagnetic signals in the frequency band and may thereby pass radio-frequency signals to and/or from phased array antenna through the display module without substantial attenuation. The phased array antenna may perform beam steering over its field of view through the filter.

DETAILED DESCRIPTION

Figure 1:
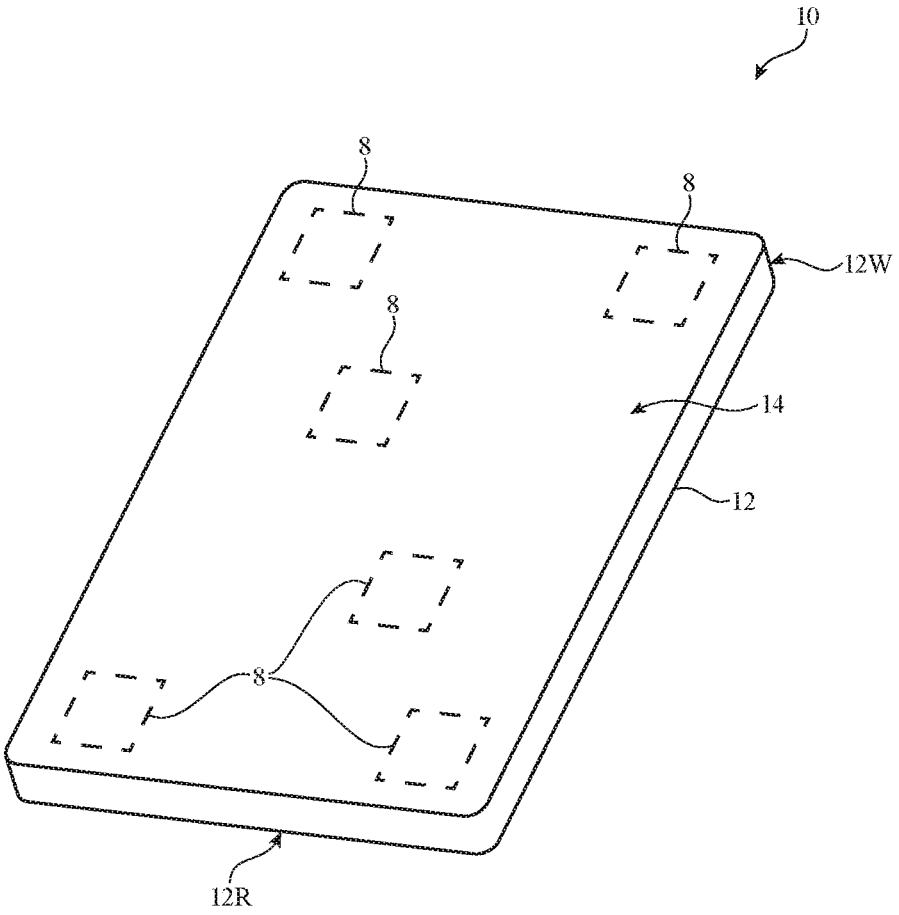
FIG. 1 is a perspective view of an illustrative electronic device with wireless communications circuitry in accordance with an embodiment.

An electronic device such as electronic device 10 of FIG. 1 may contain wireless circuitry. The wireless circuitry may include one or more antennas. The antennas may include phased array antennas that are used for handling millimeter wave and centimeter wave communications. Millimeter wave communications, which are sometimes referred to as extremely high frequency (EHF) communications, involve signals at 60 GHz or other frequencies between about 30 GHz and 300 GHz. Centimeter wave communications involve signals at frequencies between about 10 GHz and 30 GHz. If desired, device 10 may also contain wireless communications circuitry for handling satellite navigation system signals, cellular telephone signals, local wireless area network signals, near-field communications, light-based wireless communications, or other wireless communications.

Electronic devices such as device 10 in FIG. 1 may be a computing device such as a laptop computer, a computer monitor containing an embedded computer, a tablet computer, a cellular telephone, a media player, or other handheld or portable electronic device, a smaller device such as a wristwatch device, a pendant device, a headphone or earpiece device, a virtual or augmented reality headset device, a device embedded in eyeglasses or other equipment worn on a user's head, or other wearable or miniature device, a television, a computer display that does not contain an embedded computer, a gaming device, a navigation device, an embedded system such as a system in which electronic equipment with a display is mounted in a kiosk or automobile, a wireless access point or base station (e.g., a wireless router or other equipment for routing communications between other wireless devices and a larger network such as the internet or a cellular telephone network), a desktop computer, a keyboard, a gaming controller, a computer mouse, a mousepad, a trackpad or touchpad, equipment that implements the functionality of two or more of these devices, or other electronic equipment. The above-mentioned examples are merely illustrative. Other configurations may be used for electronic devices if desired.

As shown in FIG. 1, device 10 may include a housing such as housing 12. Housing 12, which may sometimes be referred to as a case, may be formed of plastic, glass, ceramics, fiber composites, metal (e.g., stainless steel, aluminum, etc.), other suitable materials, or a combination of these materials. In some situations, parts of housing 12 may be formed from dielectric or other low-conductivity material (e.g., glass, ceramic, plastic, sapphire, etc.). In other situations, housing 12 or at least some of the structures that make up housing 12 may be formed from metal elements.

Device 10 may have a display such as display 14. Display 14 may be mounted on the front face of device 10. Display 14 may be a touch screen that incorporates capacitive touch electrodes or may be insensitive to touch. The rear face of housing 12 (i.e., the face of device 10 opposing the front face of device 10) may have a planar rear housing wall. If desired, the rear housing wall may have slots that pass entirely through the rear housing wall and that therefore separate housing wall portions of housing 12 from each other. The rear housing wall may include conductive portions and/or dielectric portions. If desired, the rear housing wall may include a planar metal layer covered by a thin layer or coating of dielectric such as glass, plastic, sapphire, or ceramic. Housing 12 (e.g., the rear housing wall, sidewalls, etc.) may also have shallow grooves that do not pass entirely through housing 12. The slots and grooves may be filled with plastic or other dielectric. If desired, portions of housing 12 that have been separated from each other (e.g., by a through slot) may be joined by internal conductive structures (e.g., sheet metal or other metal members that bridge the slot).

Display 14 may include pixels formed from light-emitting diodes (LEDs), organic LEDs (OLEDs), plasma cells, electrowetting pixels, electrophoretic pixels, liquid crystal display (LCD) components, or other suitable pixel structures. A display cover layer such as a layer of clear glass or plastic may cover the surface of display 14 or the outermost layer of display 14 may be formed from a color filter layer, thin-film transistor layer, or other display layer. Display 14 may contain an active area with an array of pixels (e.g., a central substantially rectangular portion). Inactive areas of the display that are free of pixels may form borders for the active area. If desired, the active area of display 14 may extend across some or all (e.g., substantially all) of the lateral front face of device 10 (e.g., from the left edge to the right edge and from the bottom edge to the top edge of the front face of device 10).

Housing 12 may include peripheral housing structures 12W. Peripheral housing structures 12W may run around the periphery of device 10 and display 14. In configurations in which device 10 and display 14 have a rectangular shape with four edges, peripheral housing structures 12W may be implemented using peripheral housing structures that have a rectangular ring shape with four corresponding edges (as an example). Peripheral housing structures 12W or part of peripheral housing structures 12W may serve as a bezel for display 14 (e.g., a cosmetic trim that surrounds all four sides of display 14 and/or that helps hold display 14 to device 10). Peripheral housing structures 12W may, if desired, form sidewall structures for device 10 (e.g., by forming a metal band with vertical sidewalls, curved sidewalls, etc.).

Peripheral housing structures 12W may be formed of a conductive material such as metal and may therefore sometimes be referred to as peripheral conductive housing structures, conductive housing structures, peripheral metal structures, or a peripheral conductive housing member (as examples). Peripheral conductive housing structures 12W may be formed from a metal such as stainless steel, aluminum, or other suitable materials. One, two, or more than two separate structures may be used in forming peripheral conductive housing structures 12W.

It is not necessary for peripheral conductive housing structures 12W to have a uniform cross-section. For example, the top portion of peripheral conductive housing structures 12W may, if desired, have an inwardly protruding lip that helps hold display 14 in place. The bottom portion of peripheral conductive housing structures 12W may also have an enlarged lip (e.g., in the plane of the rear surface of device 10). Peripheral conductive housing structures 12W may have substantially straight vertical sidewalls, may have sidewalls that are curved, or may have other suitable shapes. In some configurations (e.g., when peripheral conductive housing structures 12W serve as a bezel for display 14), the peripheral conductive housing structures may run around the lip of housing 12 (i.e., the peripheral conductive housing structures may cover only the edge of housing 12 that surrounds display 14 and not the rest of the sidewalls of housing 12).

If desired, housing 12 may have a conductive rear surface or wall such as wall 12R (sometimes referred to herein as conductive rear housing wall 12R). For example, housing 12 may be formed from a metal such as stainless steel or aluminum. The rear surface of housing 12 may lie in a plane that is parallel to display 14. In configurations for device 10 in which the rear surface of housing 12 is formed from metal, it may be desirable to form parts of peripheral conductive housing structures 12W as integral portions of the housing structures forming the rear surface of housing 12. For example, conductive rear housing wall 12R may be formed from a planar metal structure and portions of peripheral conductive housing structures 12W on the sides of housing 12 may be formed as flat or curved vertically extending integral metal portions of the planar metal structure. Housing structures such as these may, if desired, be machined from a block of metal and/or may include multiple metal pieces that are assembled together to form housing 12. Conductive rear housing wall 12R may have one or more, two or more, or three or more portions. Peripheral conductive housing structures 12W and/or conductive rear housing wall 12R may form one or more exterior surfaces of device 10 (e.g., surfaces that are visible to a user of device 10) and/or may be implemented using internal structures that do not form exterior surfaces of device 10 (e.g., conductive housing structures that are not visible to a user of device 10 such as conductive structures that are covered with layers such as thin cosmetic layers, protective coatings, and/or other coating layers that may include dielectric materials such as glass, ceramic, plastic, or other structures that form the exterior surfaces of device 10 and/or serve to hide peripheral conductive housing structures 12W and/or conductive rear housing wall 12R from view of the user).

One or more antennas may be mounted within device 10 at one or more locations such as locations 8 shown in FIG. 1. Locations 8 may include, for example, locations at the corners of housing 12, locations at or near the center of display 14, locations along the peripheral edges of housing 12, locations between the peripheral edges of housing 12 and the center of display 14, at the rear of housing 12, under the display cover glass or other dielectric display cover layer that is used in covering and protecting display 14 on the front of device 10, under a dielectric window on a rear face of housing 12 or the edge of housing 12, or elsewhere in device 10. In general, it may be desirable for antennas within housing 12 to be able to cover a full sphere around device 10 (e.g., so that device 10 can maintain satisfactory wireless communications with external equipment regardless of the orientation of device 10 with respect to the external equipment). If care is not taken, conductive structures such as pixel circuitry and/or touch sensor circuitry in display 14 may block antennas within housing 12 from covering the full hemisphere above the front face of device 10, particularly in scenarios where the active area of display 14 extends across substantially all of the front face of device 10.

Figure 2:
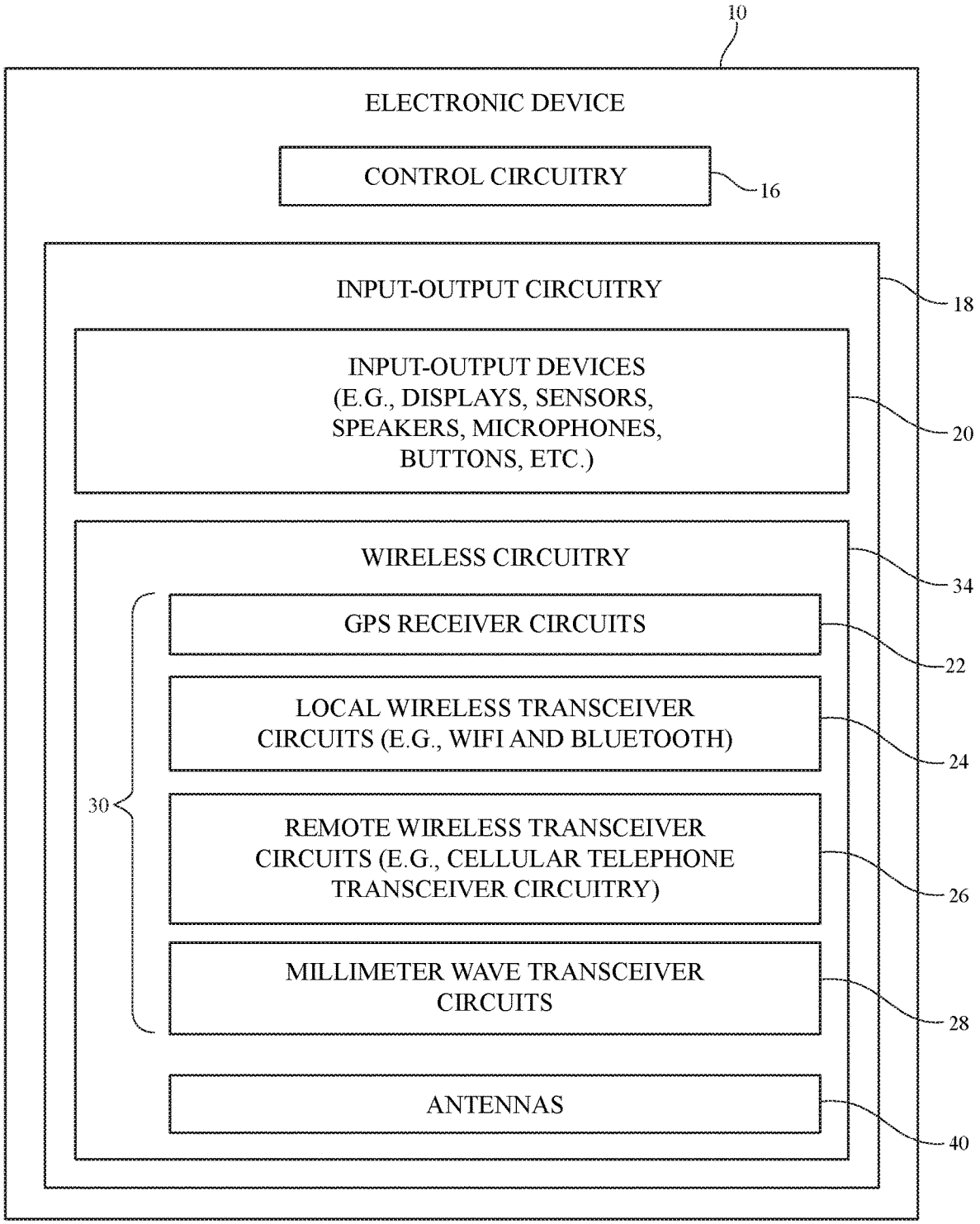
FIG. 2 is a schematic diagram of an illustrative electronic device with wireless communications circuitry in accordance with an embodiment.

A schematic diagram showing illustrative components that may be used in an electronic device such as electronic device 10 is shown in FIG. 2. As shown in FIG. 2, device 10 may include storage and processing circuitry such as control circuitry 16. Control circuitry 16 may include storage such as hard disk drive storage, nonvolatile memory (e.g., flash memory or other electrically-programmable-read-only memory configured to form a solid-state drive), volatile memory (e.g., static or dynamic random-access-memory), etc. Processing circuitry in control circuitry 16 may be used to control the operation of device 10. This processing circuitry may be based on one or more microprocessors, microcontrollers, digital signal processors, baseband processor integrated circuits, application specific integrated circuits, etc.

Control circuitry 16 may be used to run software on device 10, such as internet browsing applications, voice-over-internet-protocol (VOIP) telephone call applications, email applications, media playback applications, operating system functions, etc. To support interactions with external equipment, control circuitry 16 may be used in implementing communications protocols. Communications protocols that may be implemented using control circuitry 16 include internet protocols, wireless local area network protocols (e.g., IEEE 802.11 protocols—sometimes referred to as WiFi®), protocols for other short-range wireless communications links such as the Bluetooth® protocol or other WPAN protocols, IEEE 802.11ad protocols, cellular telephone protocols, MIMO protocols, antenna diversity protocols, satellite navigation system protocols, etc.

Device 10 may include input-output circuitry 18. Input-output circuitry 18 may include input-output devices 20. Input-output devices 20 may be used to allow data to be supplied to device 10 and to allow data to be provided from device 10 to external devices. Input-output devices 20 may include user interface devices, data port devices, and other input-output components. For example, input-output devices may include touch screens, displays without touch sensor capabilities, buttons, joysticks, scrolling wheels, touch pads, key pads, keyboards, microphones, cameras, speakers, status indicators, light sources, audio jacks and other audio port components, digital data port devices, light sensors, accelerometers or other components that can detect motion and device orientation relative to the Earth, capacitance sensors, proximity sensors (e.g., a capacitive proximity sensor and/or an infrared proximity sensor), magnetic sensors, and other sensors and input-output components.

Input-output circuitry 18 may include wireless communications circuitry 34 for communicating wirelessly with external equipment. Wireless communications circuitry 34 may include radio-frequency (RF) transceiver circuitry formed from one or more integrated circuits, power amplifier circuitry, low-noise input amplifiers, passive RF components, one or more antennas 40, transmission lines, and other circuitry for handling RF wireless signals. Wireless signals can also be sent using light (e.g., using infrared communications).

Wireless communications circuitry 34 may include radio-frequency transceiver circuitry 30 for handling various radio-frequency communications bands. For example, circuitry 34 may include transceiver circuitry 22, 24, 26, and 28.

Transceiver circuitry 24 may be wireless local area network transceiver circuitry. Transceiver circuitry 24 may handle 2.4 GHz and 5 GHz bands for WiFi® (IEEE 802.11) communications or other wireless local area network (WLAN) bands and may handle the 2.4 GHz Bluetooth® communications band or other wireless personal area network (WPAN) bands.

Circuitry 34 may use cellular telephone transceiver circuitry 26 for handling wireless communications in frequency ranges such as a low communications band from 600 to 960 MHz, a midband from 1710 to 2170 MHz, a high band from 2300 to 2700 MHz, an ultra-high band from 3400 to 3700 MHz, or other communications bands between 600 MHz and 4000 MHz or other suitable frequencies (as examples). Circuitry 26 may handle voice data and non-voice data.

Millimeter wave transceiver circuitry 28 (sometimes referred to as extremely high frequency (EHF) transceiver circuitry 28 or transceiver circuitry 28) may support communications at frequencies between about 10 GHz and 300 GHz. For example, transceiver circuitry 28 may support communications in Extremely High Frequency (EHF) or millimeter wave communications bands between about 30 GHz and 300 GHz and/or in centimeter wave communications bands between about 10 GHz and 30 GHz (sometimes referred to as Super High Frequency (SHF) bands). As examples, transceiver circuitry 28 may support communications in an IEEE K communications band between about 18 GHz and 27 GHz, a $K_a$ communications band between about 26.5 GHz and 40 GHz, a Ku communications band between about 12 GHz and 18 GHz, a V communications band between about 40 GHz and 75 GHz, a W communications band between about 75 GHz and 110 GHz, or any other desired frequency band between approximately 10 GHz and 300 GHz. If desired, circuitry 28 may support IEEE 802.11ad communications at 60 GHz and/or 5th generation mobile networks or 5th generation wireless systems (5G) communications bands between 27 GHz and 90 GHz. If desired, circuitry 28 may support communications at multiple frequency bands between 10 GHz and 300 GHz such as a first band from 27.5 GHz to 28.5 GHz, a second band from 37 GHz to 41 GHz, and a third band from 57 GHz to 71 GHz, or other communications bands between 10 GHz and 300 GHz. Circuitry 28 may be formed from one or more integrated circuits (e.g., multiple integrated circuits mounted on a common printed circuit in a system-in-package device, one or more integrated circuits mounted on different substrates, etc.). While circuitry 28 is sometimes referred to herein as millimeter wave transceiver circuitry 28, millimeter wave transceiver circuitry 28 may handle communications at any desired communications bands at frequencies between 10 GHz and 300 GHz (e.g., transceiver circuitry 28 may transmit and receive radio-frequency signals in millimeter wave communications bands, centimeter wave communications bands, etc.).

Wireless communications circuitry 34 may include satellite navigation system circuitry such as Global Positioning System (GPS) receiver circuitry 22 for receiving GPS signals at 1575 MHz or for handling other satellite positioning data (e.g., GLONASS signals at 1609 MHz). Satellite navigation system signals for receiver 22 are received from a constellation of satellites orbiting the earth.

In satellite navigation system links, cellular telephone links, and other long-range links, wireless signals are typically used to convey data over thousands of feet or miles. In WiFi® and Bluetooth® links at 2.4 and 5 GHz and other short-range wireless links, wireless signals are typically used to convey data over tens or hundreds of feet. Millimeter wave transceiver circuitry 28 may convey signals that travel (over short distances) between a transmitter and a receiver over a line-of-sight path. To enhance signal reception for millimeter and centimeter wave communications, phased array antennas and beam steering techniques may be used (e.g., schemes in which antenna signal phase and/or magnitude for each antenna in an array is adjusted to perform beam steering). Antenna diversity schemes may also be used to ensure that the antennas that have become blocked or that are otherwise degraded due to the operating environment of device 10 can be switched out of use and higher-performing antennas used in their place.

Wireless communications circuitry 34 can include circuitry for other short-range and long-range wireless links if desired. For example, wireless communications circuitry 34 may include circuitry for receiving television and radio signals, paging system transceivers, near field communications (NFC) circuitry, etc.

Antennas 40 in wireless communications circuitry 34 may be formed using any suitable antenna types. For example, antennas 40 may include antennas with resonating elements that are formed from loop antenna structures, patch antenna structures, stacked patch antenna structures, antenna structures having parasitic elements, inverted-F antenna structures, slot antenna structures, planar inverted-F antenna structures, monopoles, dipoles, helical antenna structures, Yagi (Yagi-Uda) antenna structures, surface integrated waveguide structures, hybrids of these designs, etc. If desired, one or more of antennas 40 may be cavity-backed antennas. Different types of antennas may be used for different bands and combinations of bands. For example, one type of antenna may be used in forming a local wireless link antenna and another type of antenna may be used in forming a remote wireless link antenna. Dedicated antennas may be used for receiving satellite navigation system signals or, if desired, antennas 40 can be configured to receive both satellite navigation system signals and signals for other communications bands (e.g., wireless local area network signals and/or cellular telephone signals). Antennas 40 can be arranged in a phased array (sometimes referred to herein as a phased array antenna) for handling millimeter wave communications.

Transmission line paths may be used to route antenna signals within device 10 (e.g., signals that are transmitted or received over-the-air by antennas 40). For example, transmission line paths may be used to couple antenna structures 40 to transceiver circuitry 30. Transmission line paths in device 10 may include coaxial cable paths, microstrip transmission lines, stripline transmission lines, edge-coupled microstrip transmission lines, edge-coupled stripline transmission lines, waveguide structures for conveying signals at millimeter wave frequencies (e.g., coplanar waveguides or grounded coplanar waveguides), transmission lines formed from combinations of transmission lines of these types, etc.

Transmission line paths in device 10 may be integrated into rigid and/or flexible printed circuit boards if desired. In one suitable arrangement, transmission line paths in device 10 may include transmission line conductors (e.g., signal and/or ground conductors) that are integrated within multilayer laminated structures (e.g., layers of a conductive material such as copper and a dielectric material such as a resin that are laminated together without intervening adhesive) that may be folded or bent in multiple dimensions (e.g., two or three dimensions) and that maintain a bent or folded shape after bending (e.g., the multilayer laminated structures may be folded into a particular three-dimensional shape to route around other device components and may be rigid enough to hold its shape after folding without being held in place by stiffeners or other structures). All of the multiple layers of the laminated structures may be batch laminated together (e.g., in a single pressing process) without adhesive (e.g., as opposed to performing multiple pressing processes to laminate multiple layers together with adhesive). Filter circuitry, switching circuitry, impedance matching circuitry, and other circuitry may be interposed within the transmission lines, if desired.

Device 10 may contain multiple antennas 40. The antennas may be used together or one of the antennas may be switched into use while other antenna(s) are switched out of use. If desired, control circuitry 16 may be used to select an optimum antenna to use in device 10 in real time and/or to select an optimum setting for adjustable wireless circuitry associated with one or more of antennas 40. Antenna adjustments may be made to tune antennas to perform in desired frequency ranges, to perform beam steering with a phased array antenna, and to otherwise optimize antenna performance. Sensors may be incorporated into antennas 40 to gather sensor data in real time that is used in adjusting antennas 40 if desired.

In some configurations, antennas 40 may include antenna arranged in arrays to form phased array antennas that implement beam steering functions. For example, the antennas that are used in handling millimeter wave and centimeter wave signals for transceiver circuitry 28 may be implemented in one or more phased array antennas. The radiating elements in a phased array antenna for supporting millimeter wave and centimeter wave communications may be patch antennas, dipole antennas, Yagi (Yagi-Uda) antennas, or other suitable antennas. Transceiver circuitry 28 can be integrated with the phased array antennas to form integrated phased array antenna and transceiver circuit modules or packages if desired.

In devices such as handheld devices, the presence of an external object such as the hand of a user or a table or other surface on which a device is resting has a potential to block wireless signals such as millimeter wave signals. In addition, millimeter wave communications typically require a line of sight between antennas 40 and the antennas on an external device. Accordingly, it may be desirable to incorporate multiple phased array antennas into device 10, each of which is placed in a different location within or on device 10. With this type of arrangement, an unblocked phased array antenna may be switched into use and, once switched into use, the phased array antenna may use beam steering to optimize wireless performance. Similarly, if a phased array antenna does not face or have a line of sight to an external device, another phased array antenna that has line of sight to the external device may be switched into use and that phased array antenna may use beam steering to optimize wireless performance. Configurations in which antennas from one or more different locations in device 10 are operated together may also be used (e.g., to form a phased array antenna, etc.).

Figure 3:
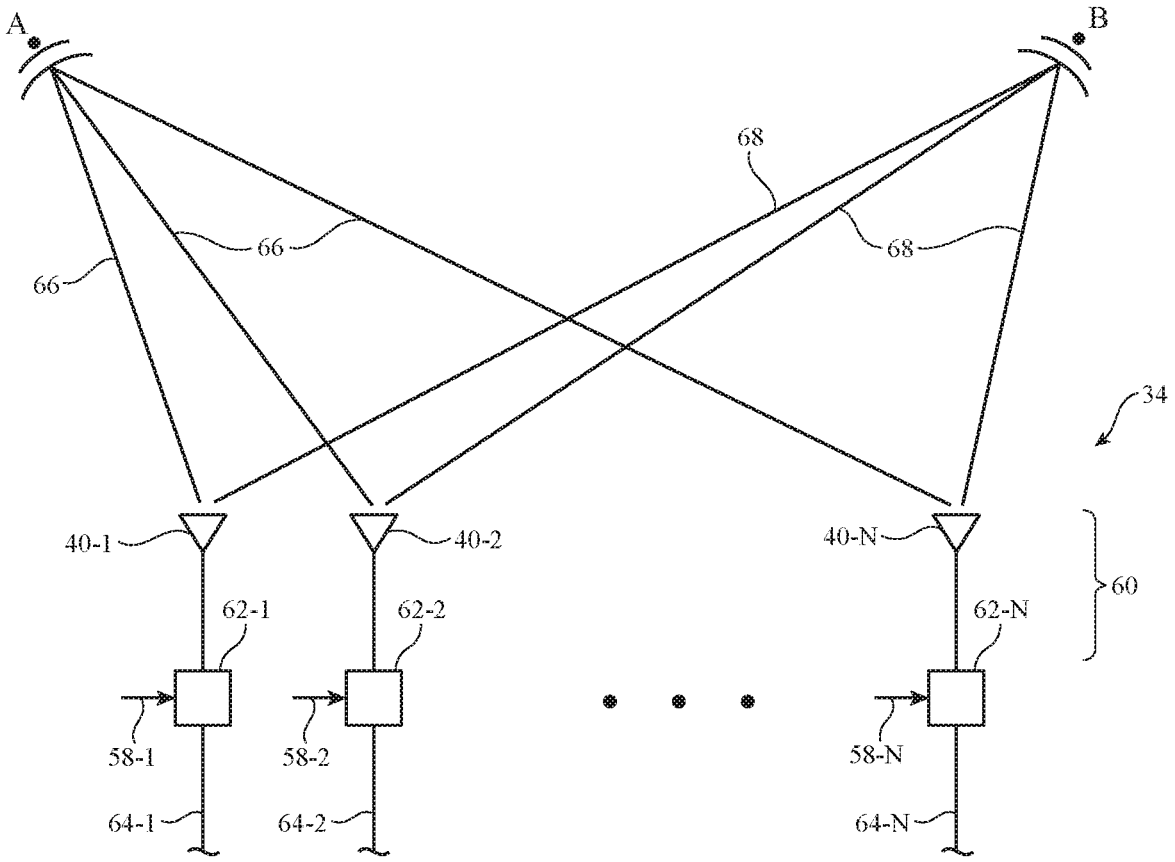
FIG. 3 is a diagram of an illustrative phased array antenna that may be adjusted using control circuitry to direct a beam of signals in accordance with an embodiment.

FIG. 3 shows how antennas 40 on device 10 may be implemented as a phased array antenna. As shown in FIG. 3, antennas 40 may be arranged in an array. While the array includes multiple individual antennas 40, the antennas in the array may sometimes be referred to herein collectively as phased array antenna 60. Phased array antenna 60 (sometimes also referred to herein as array 60, antenna array 60, array 60 of antennas 40, or phased antenna array 60) may be coupled to signal paths such as transmission line paths 64 (e.g., one or more radio-frequency transmission lines). For example, a first antenna 40-1 in phased array antenna 60 may be coupled to a first transmission line path 64-1, a second antenna 40-2 in phased array antenna 60 may be coupled to a second transmission line path 64-2, an Nth antenna 40-N in phased array antenna 60 may be coupled to an Nth transmission line path 64-N, etc. Individual antennas 40 in phased array antenna 60 may sometimes be referred to herein as antenna elements of phased array antenna 60.

Antennas 40 in phased array antenna 60 may be arranged in any desired number of rows and columns or in any other desired pattern (e.g., the antennas need not be arranged in a grid pattern having rows and columns). During signal transmission operations, transmission line paths 64 may be used to supply signals (e.g., radio-frequency signals such as millimeter wave and/or centimeter wave signals) from transceiver circuitry 28 (FIG. 2) to phased array antenna 60 for wireless transmission to external wireless equipment. During signal reception operations, transmission line paths 64 may be used to convey signals received at phased array antenna 60 from external equipment to transceiver circuitry 28 (FIG. 2).

The use of multiple antennas 40 in phased array antenna 60 allows beam steering arrangements to be implemented by controlling the relative phases and magnitudes (amplitudes) of the radio-frequency signals conveyed by the antennas. In the example of FIG. 3, antennas 40 each have a corresponding radio-frequency phase and magnitude controller 62 (e.g., a first phase and magnitude controller 62-1 interposed on transmission line path 64-1 may control phase and magnitude for radio-frequency signals handled by antenna 40-1, a second phase and magnitude controller 62-2 interposed on transmission line path 64-2 may control phase and magnitude for radio-frequency signals handled by antenna 40-2, an Nth phase and magnitude controller 62-N interposed on transmission line path 64-N may control phase and magnitude for radio-frequency signals handled by antenna 40-N, etc.).

Phase and magnitude controllers 62 may each include circuitry for adjusting the phase of the radio-frequency signals on transmission line paths 64 (e.g., phase shifter circuits) and/or circuitry for adjusting the magnitude of the radio-frequency signals on transmission line paths 64 (e.g., power amplifier and/or low noise amplifier circuits). Phase and magnitude controllers 62 may sometimes be referred to collectively herein as beam steering circuitry (e.g., beam steering circuitry that steers the beam of radio-frequency signals transmitted and/or received by phased array antenna 60).

Phase and magnitude controllers 62 may adjust the relative phases and/or magnitudes of the transmitted signals that are provided to each of the antennas in phased array antenna 60 and may adjust the relative phases and/or magnitudes of the received signals that are received by phased array antenna 60 from external equipment. The term "beam" or "signal beam" may be used herein to collectively refer to wireless signals that are transmitted and received by phased array antenna 60 in a particular direction. The term "transmit beam" may sometimes be used herein to refer to wireless radio-frequency signals that are transmitted in a particular direction whereas the term "receive beam" may sometimes be used herein to refer to wireless radio-frequency signals that are received from a particular direction.

If, for example, phase and magnitude controllers 62 are adjusted to produce a first set of phases and/or magnitudes for transmitted millimeter wave signals, the transmitted signals will form a millimeter wave frequency transmit beam as shown by beam 66 of FIG. 3 that is oriented in the direction of point A. If, however, phase and magnitude controllers 62 are adjusted to produce a second set of phases and/or magnitudes for the transmitted millimeter wave signals, the transmitted signals will form a millimeter wave frequency transmit beam as shown by beam 68 that is oriented in the direction of point B. Similarly, if phase and magnitude controllers 62 are adjusted to produce the first set of phases and/or magnitudes, wireless signals (e.g., millimeter wave signals in a millimeter wave frequency receive beam) may be received from the direction of point A as shown by beam 66. If phase and magnitude controllers 62 are adjusted to produce the second set of phases and/or magnitudes, signals may be received from the direction of point B, as shown by beam 68.

Each phase and magnitude controller 62 may be controlled to produce a desired phase and/or magnitude based on a corresponding control signal 58 received from control circuitry 16 of FIG. 2 or other control circuitry in device 10 (e.g., the phase and/or magnitude provided by phase and magnitude controller 62-1 may be controlled using control signal 58-1, the phase and/or magnitude provided by phase and magnitude controller 62-2 may be controlled using control signal 58-2, etc.). If desired, control circuitry 16 may actively adjust control signals 58 in real time to steer the transmit or receive beam in different desired directions over time.

When performing millimeter or centimeter wave communications, radio-frequency signals are conveyed over a line of sight path between phased array antenna 60 and external equipment. If the external equipment is located at location A of FIG. 3, phase and magnitude controllers 62 may be adjusted to steer the signal beam towards direction A. If the external equipment is located at location B, phase and magnitude controllers 62 may be adjusted to steer the signal beam towards direction B. In the example of FIG. 3, beam steering is shown as being performed over a single degree of freedom for the sake of simplicity (e.g., towards the left and right on the page of FIG. 3). However, in practice, the beam is steered over two or more degrees of freedom (e.g., in three dimensions, into and out of the page and to the left and right on the page of FIG. 3).

Figure 4:
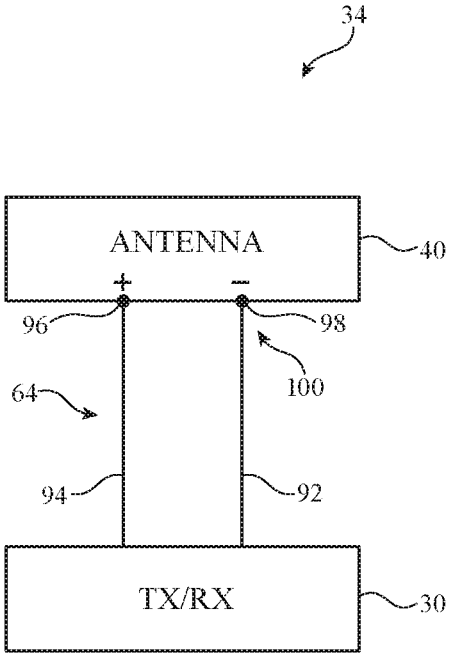
FIG. 4 is a diagram of an illustrative transceiver and antenna in accordance with an embodiment.

A schematic diagram of an antenna 40 coupled to transceiver circuitry 30 (e.g., transceiver circuitry 28 of FIG. 2) is shown in FIG. 4. As shown in FIG. 4, radio-frequency transceiver circuitry 30 may be coupled to antenna feed 100 of antenna 40 using transmission line path 64. Antenna feed 100 may include a positive antenna feed terminal such as positive antenna feed terminal 96 and may include a ground antenna feed terminal such as ground antenna feed terminal 98. Transmission line path 64 may include a positive transmission line signal path such as path 91 that is coupled to terminal 96 and a ground transmission line signal path such as path 94 that is coupled to terminal 98.

Any desired antenna structures may be used for implementing antenna 40. In one suitable arrangement that is sometimes described herein as an example, patch antenna structures may be used for implementing antenna 40. Antennas 40 that are implemented using patch antenna structures may sometimes be referred to herein as patch antennas. An illustrative patch antenna that may be used in conveying radio-frequency signals at frequencies between 10 GHz and 300 GHz is shown in FIG. 5.

Figure 5:
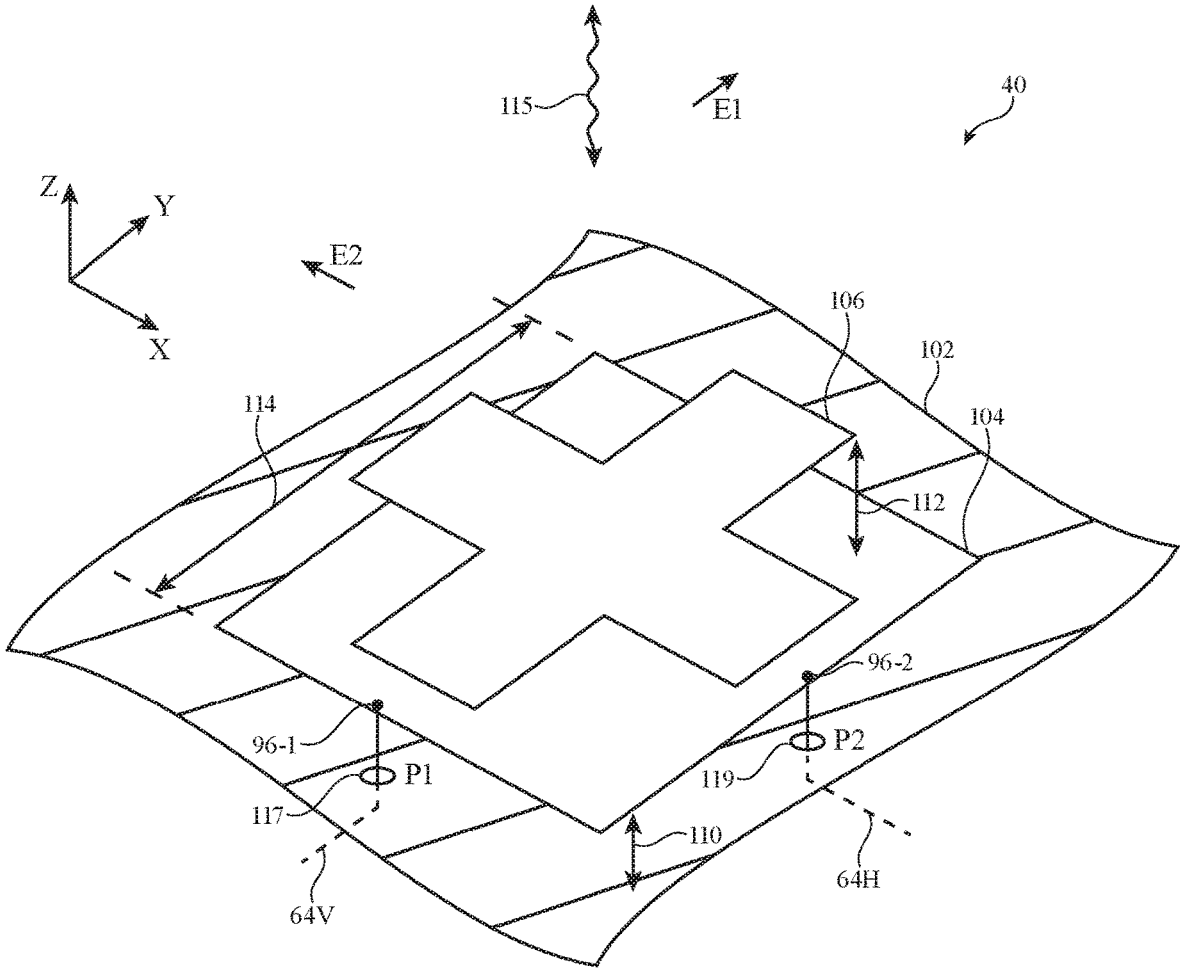
FIG. 5 is a perspective view of an illustrative patch antenna having a parasitic element in accordance with an embodiment.

As shown in FIG. 5, antenna 40 may have a patch antenna resonating element 104 that is separated from and parallel to a ground plane such as antenna ground plane 102. Patch antenna resonating element 104 may lie within a plane such as the X-Y plane of FIG. 5 (e.g., the lateral surface area of element 104 may lie in the X-Y plane). Patch antenna resonating element 104 may sometimes be referred to herein as patch 104, patch element 104, patch resonating element 104, antenna resonating element 104, or resonating element 104. Ground plane 102 may lie within a plane that is parallel to the plane of patch 104. Patch 104 and ground plane 102 may therefore lie in separate parallel planes that are separated by a distance 110. Patch 104 and ground plane 102 may be formed from conductive traces patterned on a dielectric substrate such as a rigid or flexible printed circuit board substrate, metal foil, stamped sheet metal, electronic device housing structures, or any other desired conductive structures.

The length of the sides of patch 104 may be selected so that antenna 40 resonates at a desired operating frequency. For example, the sides of patch 104 may each have a length 114 that is approximately equal to half of the wavelength of the signals conveyed by antenna 40 (e.g., the effective wavelength given the dielectric properties of the materials surrounding patch 104). In one suitable arrangement, length 114 may be between 0.8 mm and 1.2 mm (e.g., approximately 1.1 mm) for covering a millimeter wave frequency band between 57 GHz and 70 GHz, as just one example.

The example of FIG. 5 is merely illustrative. Patch 104 may have a square shape in which all of the sides of patch 104 are the same length or may have a different rectangular shape. Patch 104 may be formed in other shapes having any desired number of straight and/or curved edges. If desired, patch 104 and ground plane 102 may have different shapes and relative orientations.

To enhance the polarizations handled by antenna 40, antenna 40 may be provided with multiple feeds. As shown in FIG. 5, antenna 40 may have a first feed at antenna port P1 that is coupled to a first transmission line path 64 such as transmission line path 64V and a second feed at antenna port P2 that is coupled to a second transmission line path 64 such as transmission line path 64H. The first antenna feed may have a first ground feed terminal coupled to ground plane 102 (not shown in FIG. 5 for the sake of clarity) and a first positive feed terminal 96-1 coupled to patch 104. The second antenna feed may have a second ground feed terminal coupled to ground plane 102 (not shown in FIG. 5 for the sake of clarity) and a second positive feed terminal 96-2 on patch 104.

Holes or openings such as openings 117 and 119 may be formed in ground plane 102. Transmission line path 64V may include a vertical conductor (e.g., a conductive through-via, conductive pin, metal pillar, solder bump, combinations of these, or other vertical conductive interconnect structures) that extends through hole 117 to feed terminal 96-1 on patch 104. Transmission line path 64H may include a vertical conductor that extends through hole 119 to feed terminal 96-2 on patch 104. This example is merely illustrative and, if desired, other transmission line structures may be used (e.g., coaxial cable structures, stripline transmission line structures, etc.).

When using the first antenna feed associated with port P1, antenna 40 may transmit and/or receive radio-frequency signals having a first polarization (e.g., the electric field E1 of antenna signals 115 associated with port P1 may be oriented parallel to the Y-axis in FIG. 5). When using the antenna feed associated with port P2, antenna 40 may transmit and/or receive radio-frequency signals having a second polarization (e.g., the electric field E2 of antenna signals 115 associated with port P2 may be oriented parallel to the X-axis of FIG. 5 so that the polarizations associated with ports P1 and P2 are orthogonal to each other).

One of ports P1 and P2 may be used at a given time so that antenna 40 operates as a single-polarization antenna or both ports may be operated at the same time so that antenna 40 operates with other polarizations (e.g., as a dual-polarization antenna, a circularly-polarized antenna, an elliptically-polarized antenna, etc.). If desired, the active port may be changed over time so that antenna 40 can switch between covering vertical or horizontal polarizations at a given time. Ports P1 and P2 may be coupled to different phase and magnitude controllers 62 (FIG. 3) or may both be coupled to the same phase and magnitude controller 62. If desired, ports P1 and P2 may both be operated with the same phase and magnitude at a given time (e.g., when antenna 40 acts as a dual-polarization antenna). If desired, the phases and magnitudes of radio-frequency signals conveyed over ports P1 and P2 may be controlled separately and varied over time so that antenna 40 exhibits other polarizations (e.g., circular or elliptical polarizations).

If care is not taken, antennas 40 such as dual-polarization patch antennas of the type shown in FIG. 5 may have insufficient bandwidth for covering an entirety of a communications band of interest (e.g., a communications band at frequencies greater than 10 GHz). For example, in scenarios where antenna 40 is configured to cover a millimeter wave communications band between 57 GHz and 71 GHz, patch 104 as shown in FIG. 5 may have insufficient bandwidth to cover the entirety of the frequency range between 57 GHz and 71 GHz. If desired, antenna 40 may include one or more parasitic antenna resonating elements that serve to broaden the bandwidth of antenna 40.

As shown in FIG. 5, a bandwidth-widening parasitic antenna resonating element such as parasitic antenna resonating element 106 may be formed from conductive structures located at a distance 112 over patch 104. Parasitic antenna resonating element 106 may sometimes be referred to herein as parasitic resonating element 106, parasitic antenna element 106, parasitic element 106, parasitic patch 106, parasitic conductor 106, parasitic structure 106, parasitic 106, or patch 106. Parasitic element 106 is not directly fed, whereas patch 104 is directly fed via transmission line paths 64V and 64H and feed terminals 96-1 and 96-2. Parasitic element 106 may create a constructive perturbation of the electromagnetic field generated by patch 104, creating a new resonance for antenna 40. This may serve to broaden the overall bandwidth of antenna 40 (e.g., to cover the entire millimeter wave frequency band from 57 GHz to 71 GHz).

At least some or an entirety of parasitic element 106 may overlap patch 104. In the example of FIG. 5, parasitic element 106 has a cross or "X" shape. In order to form the cross shape, parasitic element 106 may include notches or slots formed by removing conductive material from the corners of a square or rectangular metal patch. Parasitic element 106 may have a rectangular (e.g., square) outline or footprint. Removing conductive material from parasitic element 106 to form a cross shape may serve to adjust the impedance of patch 104 so that the impedance of patch 104 is matched to both transmission line paths 64V and 64H, for example. The example of FIG. 5 is merely illustrative. If desired, parasitic element 106 may have other shapes or orientations.

If desired, antenna 40 of FIG. 5 may be formed on a dielectric substrate (not shown in FIG. 5 for the sake of clarity). The dielectric substrate may be, for example, a rigid or printed circuit board or other dielectric substrate. The dielectric substrate may include multiple stacked dielectric layers (e.g., multiple layers of printed circuit board substrate such as multiple layers of fiberglass-filled epoxy, multiple layers of ceramic substrate, etc.). Ground plane 102, patch 104, and parasitic element 106 may be formed on different layers of the dielectric substrate if desired.

When configured in this way, antenna 40 may cover a relatively wide millimeter wave communications band of interest such as a frequency band between 57 GHz and 71 GHz. The example of FIG. 5 is merely illustrative. Parasitic element 106 may be omitted if desired. Antenna 40 may have any desired number of feeds. Other antenna types may be used if desired.

In order to perform wireless communications in millimeter and centimeter wave communications bands over the hemisphere above the front face of device 10, it may be desirable to mount phased array antenna 60 behind display 14 (e.g., within a corresponding region 8 as shown in FIG. 1). However, as the active area of display 14 extends across the entire length and width of device 10, conductive material used to form the active area of display 14 may also extend across the entire length and width of device 10. If care is not taken, this conductive material may undesirably block phased array antenna 60 mounted behind display 14 from being able to satisfactorily communicate over the hemisphere above the front face of device 10.

Figure 6:
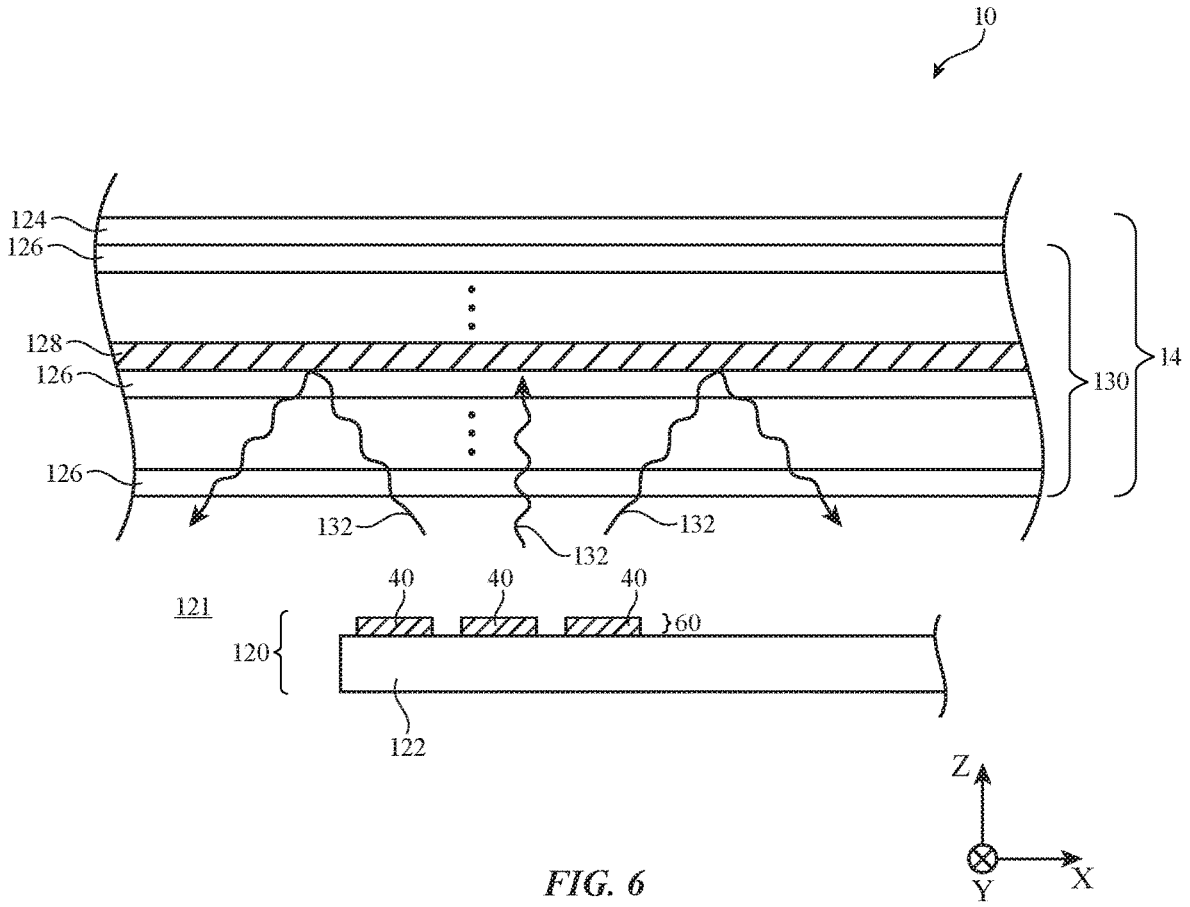
FIG. 6 is a cross-sectional side view of an illustrative electronic device having a phased array antenna that is blocked by conductive layers in a display in accordance with an embodiment.

FIG. 6 is a cross-sectional side view showing how conductive structures in display 14 may block radio-frequency signals transmitted by phased array antenna 60. As shown in FIG. 6, housing 12 (FIG. 1) and display 14 may define an interior 121 of device 10. Phased array antenna 60 may be formed on a dielectric substrate such as substrate 122 disposed within interior 121 of device 10.

Substrate 122 may be, for example, a rigid or flexible printed circuit board or other dielectric substrate. Substrate 122 may include multiple stacked dielectric layers (e.g., multiple layers of printed circuit board substrate such as multiple layers of fiberglass-filled epoxy) or may include a single dielectric layer. Substrate 122 may include any desired dielectric materials such as epoxy, plastic, ceramic, glass, foam, or other materials. Antennas 40 in phased array antenna 60 may be mounted at a surface of substrate 122 or may be partially or completely embedded within substrate 122 (e.g., within a single layer of substrate 122 or within multiple layers of substrate 122). In one suitable example, ground plane 102, patch 104, and parasitic element 106 of each antenna 40 (as shown in the example of FIG. 5) may be formed on separate layers of substrate 122 (e.g., parasitic element 106 may be formed on an exposed surface of substrate 122 whereas patch 104 and ground plane 102 are embedded within the layers of substrate 122).

Phased array antenna 60 and substrate 122 may sometimes be referred to herein collectively as antenna module 120. If desired, transceiver circuitry 28 of FIG. 2 or other transceiver circuits may be mounted to antenna module 120 (e.g., at a surface of substrate 122 or embedded within substrate 122). The example of FIG. 6 is merely illustrative. In general, any desired number of antennas 40 may be included in phased array antenna 60 and mounted to substrate 122. Additional phased array antennas may be mounted at other locations along substrate 122 and/or on the bottom side of substrate 122 if desired.

As shown in FIG. 6, display 14 may include a display cover layer 124 (e.g., a clear layer of plastic, glass, sapphire, etc.) and display structures 130 for producing images for a user. Display cover layer 124 may cover display structures 130 and may form an exterior surface of device 10 (e.g., the exterior surface at the front face of device 10). Display structures 130 may sometimes be referred to herein as display stack 130 or display module 130. Display module 130 may include liquid crystal display structures, electrophoretic display structures, light-emitting diode display structures such as organic light-emitting diode display structures, or other suitable display structures. Display module 130 may include an array of pixels for displaying images for a user and may form the active area of display 14. Pixels in display module 130 may emit (display) light (images) through display cover layer 124 that are to be viewed by a user.

Display module 130 may include multiple display layers 126. Display layers 126 may include layers of backlight structures, layers of light guide structures, layers of light source structures such as layers that include an array of light-emitting diodes or other display pixel circuitry, light reflector structures, optical films, diffuser layers, light collimating layers, polarizer layers, planarization layers, liquid crystal layers, color filter layers, thin-film transistor layers, optically transparent substrate layers, optically opaque substrate layers, layers for forming touch sensor electrodes associated with touch sensing capabilities for display 14 (in scenarios where display 14 is a touch sensor), birefringent compensating films, antireflection coatings, scratch prevention coatings, oleophobic coatings, layers of adhesive, stretched polymer layers such as stretched polyvinyl alcohol layers, tri-acetyl cellulose layers, antiglare layers, plastic layers, and/or any other desired layers used to form display structures for displaying images to a user of device 10 and/or for receiving a touch or force input from a user of device 10.

Dielectric materials within display layers 126 may have dielectric constants between about 2.0 and 5.0, as an example. Dielectric material in display cover layer 124 may have a dielectric constant between about 5.0 and 7.0, as an example. Display layers 126 may have thicknesses (e.g., in the direction of the Z-axis of FIG. 6) of between about 1 micron and 200 microns whereas display cover layer 124 has a thickness of between about 600 microns and 1200 microns (e.g., 800 microns). These examples are merely illustrative and, in general, display layers 126 and display cover layer 124 may have any desired dielectric properties and thicknesses.

Display layers 126 that include only dielectric materials (e.g., adhesive layers, color filter layers, polarizer layers, etc.) may be substantially transparent to radio-frequency signals (e.g., may transmit radio-frequency signals without significant attenuation). One or more display layers 126 in display module 130 such as layer 128 of FIG. 6 may be opaque to radio-frequency signals. Radio-frequency opaque layers such as layer 128 may include conductive structures that block radio-frequency signals at relatively high frequencies (e.g., frequencies over 10 GHz such as centimeter and millimeter wave frequencies) and may therefore sometimes be referred to herein as conductive layer 128, radio-frequency opaque layer 128, centimeter wave opaque layer 128, millimeter wave opaque layer 128, or conductive radio-frequency opaque layer 128.

Radio-frequency opaque layer 128 may include, for example, pixel circuitry, pixel electrode structures, thin-film transistors, or other conductive structures involved in displaying images using display 14. Radio-frequency opaque layer 128 may additionally or alternatively include circuitry and/or electrodes involved in gathering touch or force sensor inputs for display 14 from a user (e.g., in scenarios where display 14 is also a touch-sensitive or force-sensitive display). For example, radio-frequency opaque layer 128 may include an array of capacitive electrodes (e.g., transparent electrodes such as indium tin oxide electrodes) or may include a touch sensor array based on other touch technologies (e.g., resistive touch sensor structures, acoustic touch sensor structures, piezoelectric sensors and other force sensor structures, etc.). Touch sensor structures for display 14 may be implemented on a dedicated touch sensor substrate in display module 130 such as a layer of glass or may be formed on the same substrate that is being used for other display functions. For example, touch sensor electrodes may be formed on a color filter array layer, a thin-film transistor layer, or other layers in a liquid crystal display. In general, radio-frequency opaque layer 128 may include any conductive display structures that are opaque to radio-frequency signals at frequencies greater than 10 GHz.

During millimeter wave communications, phased array antenna 60 may transmit radio-frequency signals 132 at frequencies greater than 10 GHz. Radio-frequency signals 132 may freely pass through dielectric display layers 126 of display module 130. However, radio-frequency opaque layer 128 in display module 130 may block radio-frequency signals 132, serving to reflect signals 132 back towards interior 121 of device 10. Radio-frequency opaque layer 128 thereby prevents the transmission of signals 132 to the exterior of device 10 through display module 130. If device 10 is attempting communications with external equipment located in the hemisphere above display 14, signals 132 will thereby fail to be received at the external equipment. Similarly, radio-frequency opaque layer 128 may block radio-frequency signals from external equipment from being received at phased array antenna 60 through display module 130.

In order to allow radio-frequency signals transmitted by phased array antenna 60 to be conveyed through display module 130, display module 130 may include a filter within radio-frequency opaque layer 128. The filter may, for example, be an electromagnetic filter such as a frequency selective filter that passes electromagnetic signals at some radio-frequencies (e.g., within a pass band of the filter) and that blocks electromagnetic signals at other frequencies (e.g., outside of the pass band of the filter). The frequency selective filter may, in one scenario, be a spatial filter that includes conductive structures that are arranged in a periodic manner to define the pass band of the filter (e.g., to allow transmission of electromagnetic signals within the pass band while blocking electromagnetic signals outside of the pass band). In this scenario, the conductive structures and/or slots between the conductive structures are resonant at the center frequency of the pass band. In one suitable arrangement, the frequency selective filter may include conductive structures that are arranged to form a low pass filter that passes electromagnetic signals below a cut off frequency. In this scenario, the conductive structures may be much smaller than the operating wavelength of phased array antenna 60 and may not in themselves be resonant (e.g., such that gaps between the conductive structures are invisible to the unaided human eye). In scenarios where the frequency selective filter is formed using a single layer of conductive material in display module 130 (e.g., using conductive material in a single radio-frequency opaque layer 128), the frequency selective filter may sometimes be referred to herein as a frequency selective surface (FSS).

Figure 7:
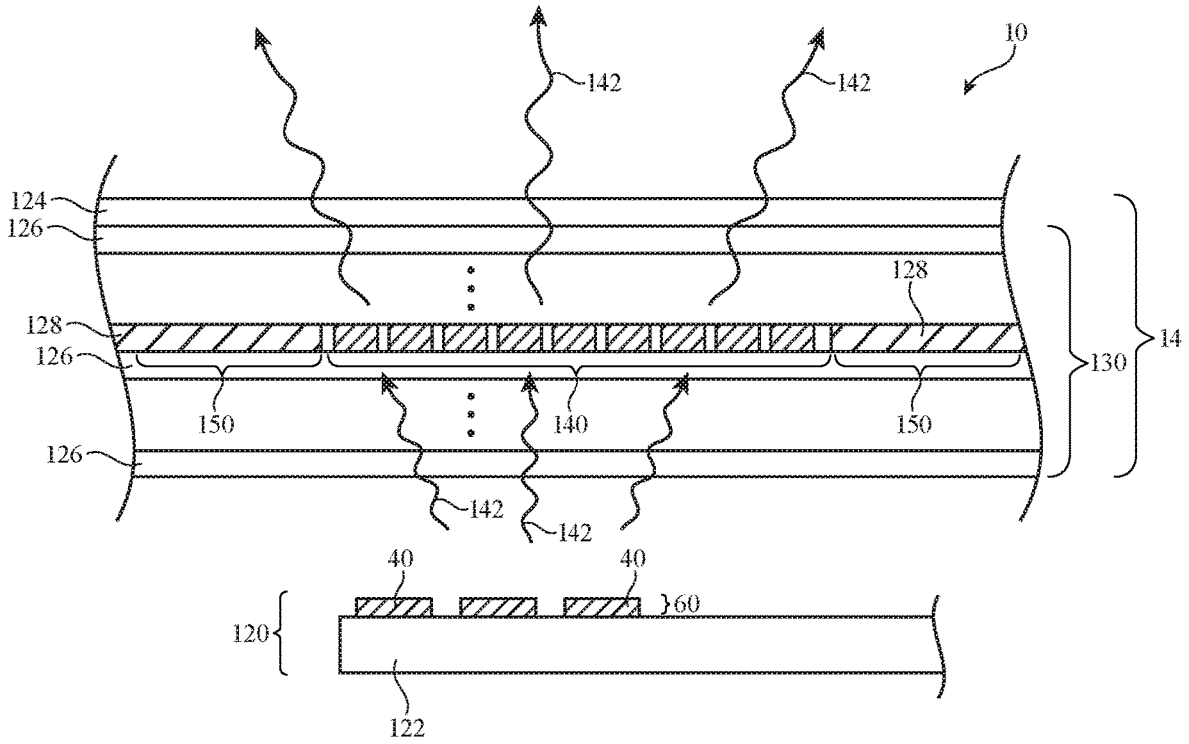
FIG. 7 is a cross-sectional side view of an illustrative electronic device having a filter in a conductive layer of a display that passes radio-frequency signals for a phased array antenna in accordance with an embodiment.

FIG. 7 is a cross-sectional side view showing how display module 130 may include a filter in radio-frequency opaque layer 128 for passing radio-frequency signals handled by phased array antenna 60. As shown in FIG. 7, radio-frequency opaque layer 128 may include a filter 140. Filter 140 may sometimes be referred to herein as spatial filter 140, frequency selective filter 140, or frequency selective surface 140 (in scenarios where filter 140 is formed using a single radio-frequency opaque layer 128).

Filter 140 may be formed using a pattern of periodic slots in radio-frequency opaque layer 128 that divides radio-frequency opaque layer 128 into a pattern of periodic conductive structures within filter 140. Filter 140 may allow radio-frequency signals at certain frequencies (e.g., below a cut off frequency of filter 140 where filter 140 serves as a low pass filter) to freely pass through layer 128 and thus display module 130. The dimensions of the slots and conductive structures (e.g., the periodicity of the slots and conductive structures) within filter 140 may be selected so that the slots and conductive structures resonate at the center of a pass band of filter 140 (e.g., to tune the pass band of filter 140 to overlap with the frequency band of operation of phased array antenna 60) or may be selected so that the slots and conductive structures are much smaller than the operating wavelength of phased antenna array 60 and thus are not resonant at the operating frequency of phased array antenna 60 (e.g., to tune the cutoff frequency of filter 140 where filter 140 serves as a low pass filter). Configuring the slots and conductive structures to be much smaller than the operating wavelength of phased antenna array 60 may desirably allow the slots and conductive structures to be indiscernible to the user's eye, for example. When filter 140 is configured to pass radio-frequency signals in the frequency band of operation for phased array antenna 60, radio-frequency signals 142 transmitted by phased array antenna 60 may freely pass through radio-frequency opaque layer 128 and display module 130 to the exterior of device 10. Similarly, radio-frequency signals may be received by phased array antenna 60 through filter 140 in display module 130. In this way, phased array antenna 60 may be able to communicate with external equipment located in the hemisphere above display 14 despite the presence of conductive structures in display module 130.

In other words, when configured in this way, filter 140 may effectively form an antenna window in radio-frequency opaque layer 128 and thus display module 130 that is transparent at the frequencies of operation of phased array antenna 60 (e.g., an antenna window that is transparent to radio-frequency signals at frequencies greater than 10 GHz). The portion 150 of radio-frequency opaque layer 128 that laterally surrounds filter 140 may remain opaque to radio-frequency signals handled by phased array antenna 60. Portion 150 of radio-frequency opaque layer 128 may therefore sometimes be referred to herein as radio-frequency opaque portion, region, or area 150 of display module 130.

Figure 8:
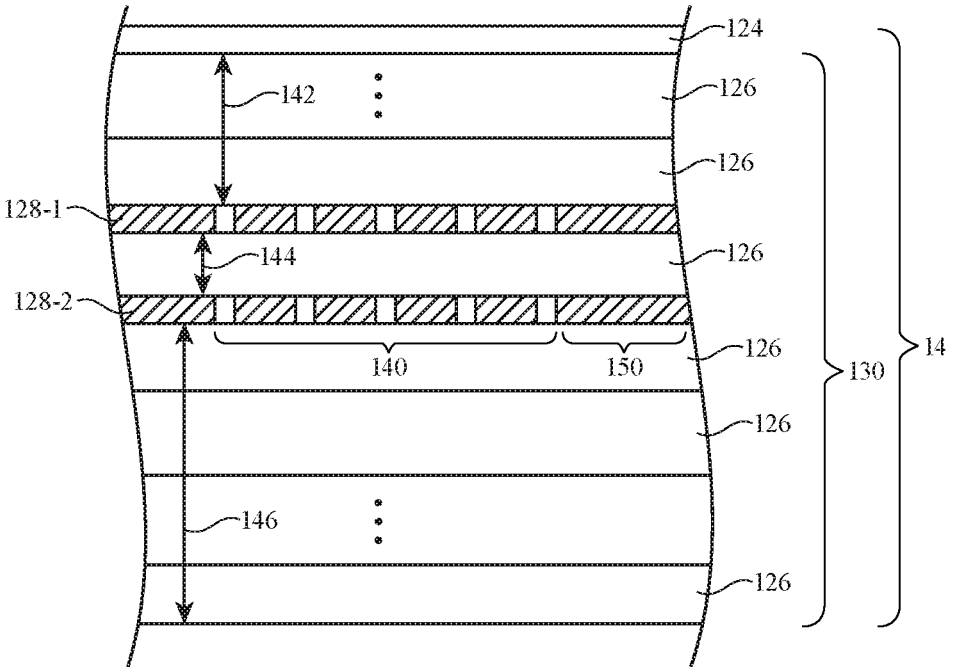
FIG. 8 is a cross-sectional side view of an illustrative electronic device having a filter formed from multiple conductive layers in a display in accordance with an embodiment.

In the example of FIG. 7, filter 140 is formed in a single radio-frequency opaque layer 128 in display module 130. This is merely illustrative. If desired, filter 140 may be formed using multiple radio-frequency opaque layers 128 in display module 130. FIG. 8 is a cross-sectional side view showing how filter 140 may be formed from two radio-frequency opaque layers 128 in display module 130.

As shown in FIG. 8, display module 130 may include a first radio-frequency opaque layer 128-1 and a second radio-frequency opaque layer 128-2 under first radio-frequency opaque layer 128-1. One or both of radio-frequency opaque layers 128-1 and 128-2 may include conductive structures associated with displaying images and/or receiving touch or force sensor inputs for display 14 (e.g., thin film transistor structures, indium tin oxide structures, etc.). For example, both radio-frequency opaque layers 128-1 and 128-2 may include indium tin oxide structures for gathering touch input using display 14.

First radio-frequency opaque layer 128-1 may be vertically separated from second radio-frequency opaque layer 128-2 by distance 144 (e.g., by one intervening display layer 126 or multiple intervening display layers 126 of display module 130). First radio-frequency opaque layer 128-1 may be vertically separated from display cover layer 124 by distance 142 (e.g., across zero, one, or multiple display layers 126). Second radio-frequency opaque layer 128-2 may be vertically separated from the bottom of display module 130 by distance 146 (e.g., across zero, one, or multiple display layers 126).

In the example of FIG. 8, filter 140 may be formed using patterns of periodic slots in both first radio-frequency opaque layer 128-1 and second radio-frequency opaque layer 128-2. The pattern of slots in first radio-frequency opaque layer 128-1 may divide radio-frequency opaque layer 128-1 into a first pattern of periodic conductive structures within filter 140. Similarly, the pattern of slots in second radio-frequency opaque layer 128-2 may divide radio-frequency opaque layer 128-2 into a second pattern of periodic conductive structures within filter 140. The slots and conductive structures in first radio-frequency opaque layer 128-1 may be aligned with the slots and conductive structures, respectively, in second radio-frequency opaque layer second 128-2 within filter 140.

In this way, filter 140 may include vertically stacked conductive structures formed from conductive material in two radio-frequency opaque layers 128 of display module 130. The dimensions of the slots and conductive structures (e.g., the periodicity of the slots and conductive structures) within filter 140 may be selected to tune the cutoff frequency of filter 140 to be greater than the frequency band of operation of phased array antenna 60 (e.g., so that filter 140 serves as a low pass filter that passes radio-frequency signals handled by phased array antenna 60). When configured in this way, radio-frequency signals handled by phased array antenna 60 may freely pass through both radio-frequency opaque layers 128-1 and 128-2 and thus display module 130. Forming filter 140 across two layers 128-1 and 128-2 may, for example, add transverse capacitances to filter 140 that allow the dimensions of the slots and conductive structures in filter 140 to be smaller than in scenarios where only a single layer 128 is used (e.g., as shown in FIG. 7) while still passing radio-frequency signals at the same frequencies. The dimensions of the slots and conductive structures in filter 140 may be much smaller than the wavelength of operation of phased array antenna 60 and may therefore be non-resonant at the wavelength of operation of phased array antenna 60 (e.g., the structures may be resonant at a wavelength much smaller than the wavelength the wavelength of operation).

In other words, when configured in this way, filter 140 may effectively form an antenna window in radio-frequency opaque layers 128-1 and 128-2 and thus display module 130 that is transparent at the frequencies of operation of phased array antenna 60 (e.g., an antenna window that is transparent to radio-frequency signals at greater than 10 GHz). In the example of FIG. 8, radio-frequency opaque portion 150 of display module 130 may be defined by radio-frequency opaque portions of one or both of radio-frequency opaque layers 128-1 and 128-2 that laterally surround filter 140 in display module 130.

Figure 9:
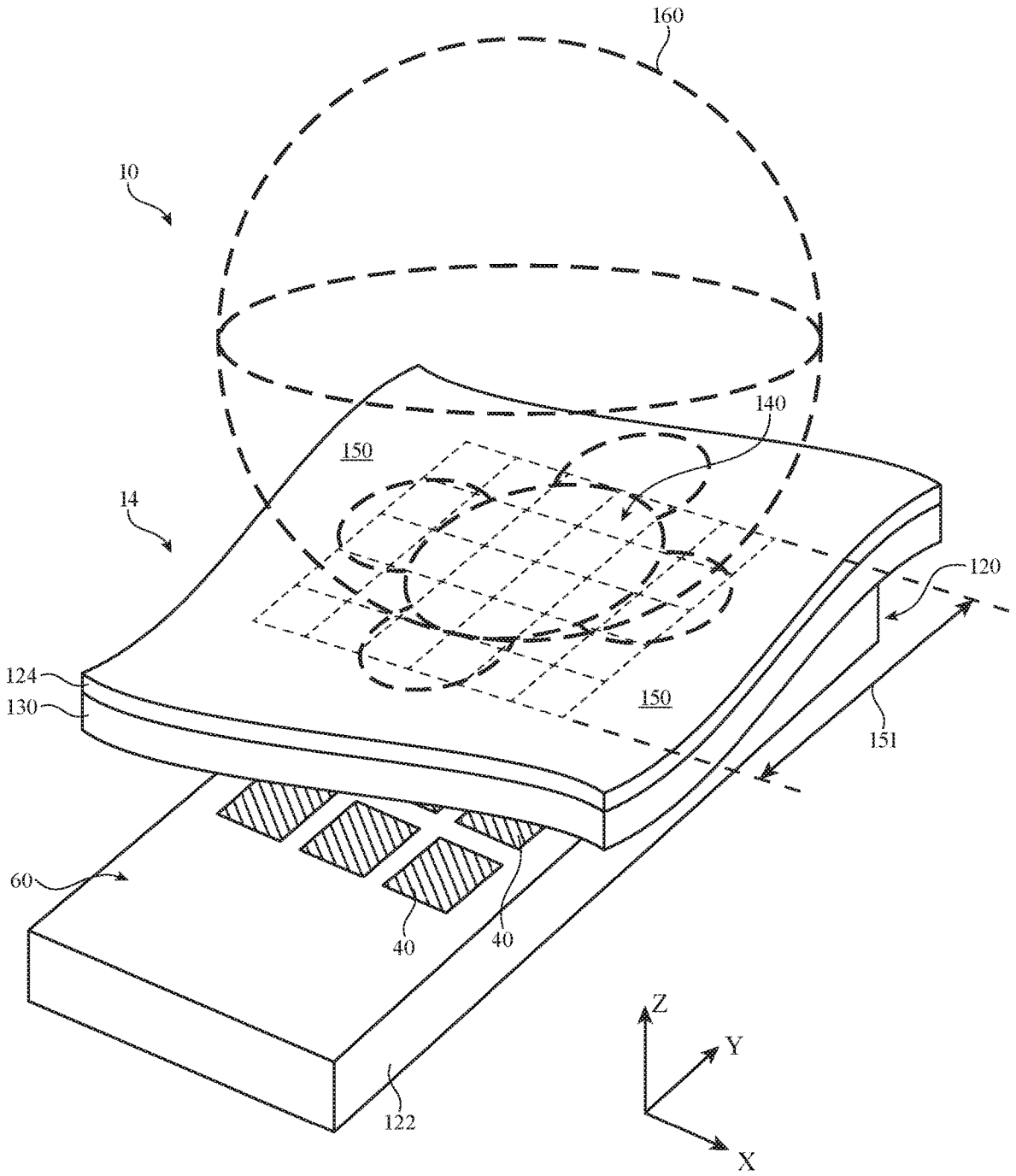
FIG. 9 is a perspective view of an illustrative display of the types shown in FIGS. 7 and 8 having a filter that passes radio-frequency signals for a phased array antenna in accordance with an embodiment.

Filter 140 may extend across a sufficiently large lateral area of display 14 to allow phased array antenna 60 to perform beam steering over substantially all of the hemisphere above display 14. FIG. 9 is a perspective view of display 14 and antenna module 120 showing how phased array antenna 60 may be aligned with filter 140 for covering the hemisphere above display 14.

As shown in FIG. 9, filter 140 may extend across a length 151 of the lateral surface area of display 14 (e.g., in the X-Y plane of FIG. 9). Filter 140 may have a rectangular outline, a square outline, or any other suitable lateral outline (e.g., a circular outline, a polygonal outline, an outline having curved and/or straight edges, etc.). Length 151 may, for example, be between 5 mm and 15 mm (e.g., 10 mm), between 3 mm and 20 mm, 15 mm, greater than 15 mm, or any other desired length that would allow phased array antenna 60 to cover substantially all of the hemisphere above display 14.

Radio-frequency opaque portion 150 of display module 130 laterally surrounds filter 140 in display module 130. Filter 140 may be completely surrounded (e.g., on all sides) or may be partially surrounded on one or more sides by radio-frequency opaque portion 150 of display module 130 (e.g., radio-frequency opaque portion 150 may laterally surround one side of filter 140 when radio-frequency opaque portion 150 defines one edge of filter 140, may laterally surround two sides of filter 140 when radio-frequency opaque portion 150 defines two edges of filter 140, etc.). In one particular arrangement, filter 140 may be formed at an edge of display 14 such that one edge of filter 140 is defined by a peripheral conductive sidewall 12W (FIG. 1) and the remaining three sides of filter 140 are laterally surrounded by (e.g., the remaining three edges of filter 140 are defined by) radio-frequency opaque portion 150 of display module 130. In another particular arrangement, filter 140 may be formed at a corner of display 14 such that two edges of filter 140 are defined by two peripheral conductive sidewalls 12W (FIG. 1) and the remaining two sides of filter 140 are laterally surrounded by (e.g., the remaining two edges of filter 140 are defined by) radio-frequency opaque portion 150 of display module 130. In another suitable arrangement, radio-frequency opaque portion 150 of display module 130 defines all lateral edges of filter 140 (e.g., in scenarios where radio-frequency opaque portion 150 of display module 130 completely surrounds filter 140). The lateral edges of filter 140 may be straight and/or curved (e.g., may include straight portions, curved portions, straight portions with rounded corners, etc.). In contrast with radio-frequency opaque portion 150, filter 140 is transparent to radio-frequency signals handled by phased array antenna 60 and therefore allows the radio-frequency signals to pass through display module 130.

Phased array antenna 60 on substrate 122 may be aligned with filter 140 in display module 130. When aligned with filter 140, phased array antenna 60 may exhibit a radiation pattern associated with a pattern envelope such as pattern envelope 160 of FIG. 9. Pattern envelope (curve) 160 may be indicative of the gain of the radio-frequency signals transmitted by phased array antenna 60 when steered over the entire field of view for the phased array antenna (e.g., the beam of signals handled by phased array antenna 60 and steered in a particular direction at any given time only extends across a small subset of envelope 160).

The distance of pattern envelope 160 from the center of phased array antenna 60 is indicative of the gain of the phased array antenna at different beam steering angles. As shown by pattern envelope 160, phased array antenna 60 may exhibit a relatively uniform gain when steered over all possible directions within its field of view (e.g., over substantially all of the hemisphere of coverage for the array). Phased array antenna 60 may be mounted at a selected vertical distance from filter 140 and the lateral area of filter 140 (e.g., as defined by length 151) may be selected so that the beam of signals transmitted and received by phased array antenna 60 can pass through frequency selective filter 140 across substantially all of the field of view of phased array antenna 60 (e.g., across substantially all of the hemisphere over display 10 regardless of the direction the beam is steered towards).

Display module 130 may emit display light through display cover layer 124 within the lateral outline of radio-frequency opaque portion 150 of display module 130 while also blocking radio-frequency signals at millimeter wave frequencies from passing through radio-frequency opaque portion 150 (e.g., display pixel circuits and other circuitry associated with displaying image light may be present in display module 130 within the lateral outline of radio-frequency opaque portion 150 of display module 130). Display module 130 may receive touch sensor and/or force sensor inputs associated with a user pressing on display cover layer 124 within the lateral outline of radio-frequency opaque portion 150 while also blocking radio-frequency signals at millimeter wave frequencies from passing through radio-frequency opaque portion 150 (e.g., touch sensor electrodes, force sensor circuitry, and/or other touch sensor circuitry may be present within the lateral outline of radio-frequency opaque portion 150 of display module 130)

The example of FIG. 9 is merely illustrative. In general, pattern envelope 160 may have any shape (e.g., corresponding to the particular arrangement of antennas 40 in phased array antenna 60, the geometry of phased array antenna 60, the materials used to form substrate 120 and display 14, the frequency of operation of phased array antenna 60, the transmission characteristics of filter 140, etc.). Phased array antenna 60 may include any desired number of antennas 40 arranged in any desired pattern.

Figure 10:
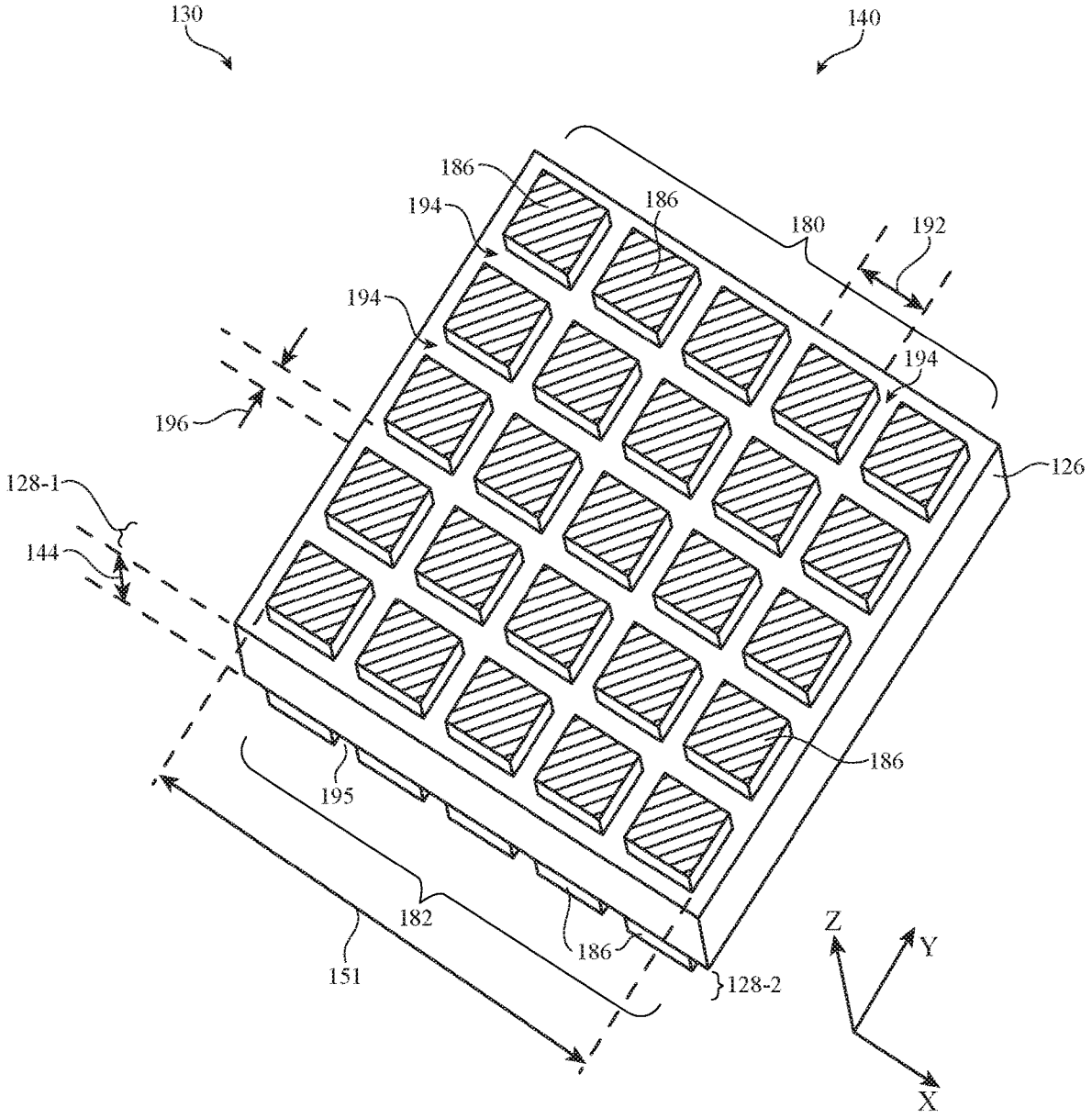
FIG. 10 is a perspective view of a filter formed from multiple conductive layers in a display in accordance with an embodiment.

FIG. 10 is a perspective view of one suitable arrangement for filter 140 in which filter 140 is formed using first radio-frequency opaque layer 128-1 and second radio-frequency opaque layer 128-2 in display module 130 (e.g., as shown in FIG. 8). In the example of FIG. 10, filter 140 may include a first pattern 180 of conductive structures 186 formed on a first side of a given display layer 126 and a second pattern 182 of conductive structures 186 formed on an opposing second side of the display layer 126. Conductive structures 186 may sometimes be referred to herein as conductive patches 186. Conductive patches 186 in first pattern 180 may, for example, be arranged in an array. First pattern 180 of conductive patches 186 may therefore sometimes be referred to herein as first array 180 of conductive patches 186. Similarly, the conductive patches 186 in second pattern 182 may be arranged in an array. Second pattern 182 of conductive patches 186 may therefore sometimes be referred to herein as second array 182 of conductive patches 186.

First array 180 of conductive patches 186 may be formed from conductive material in first radio-frequency opaque layer 128-1 whereas second array 182 of conductive patches 186 may be formed from conductive material in second radio-frequency opaque layer 128-2. Radio-frequency opaque portion 150 of display module 130 laterally surrounds one or more sides of arrays 180 and 182 (e.g., as shown in FIGS. 8 and 9) and is not shown in FIG. 10 for the sake of clarity. Other display layers above and below filter 140 in display module 130 are also omitted from FIG. 10 for the sake of clarity.

As shown in FIG. 10, filter 140 may extend across length 151 of display module 130. Conductive patches 186 in first array 180 may be periodically distributed in the X-Y plane. Similarly, conductive patches 186 in second array 180 may be periodically distributed in the X-Y plane. Each conductive patch 186 in first array 180 may be aligned with and completely overlap a corresponding conductive patch 186 in second array 182. First array 180 may include the same number of conductive patches 186 as second array 182 and each conductive patch 186 in first array 180 and second array 182 may have the same size and shape.

Conductive patches 186 may be formed from metal traces on display layer 126, from metal foil, or any other desired conductive structures. Conductive patches 186 may be formed, for example, from copper, aluminum, stainless steel, silver, gold, nickel, tin, indium tin oxide, other metals or metal alloys, or any other desired conductive materials. Conductive patches 186 may be formed from the same material as the portions of radio-frequency opaque layers 128-1 and 128-2 laterally surrounding filter 140 (e.g., the portion of layers 128-1 and 128-2 forming radio-frequency opaque portion 150 of display module 130 as shown in FIG. 9). In another suitable arrangement, conductive patches 186 may be formed from a different material than the portions of radio-frequency opaque layers 128-1 and 128-2 laterally surrounding filter 140. As an example, conductive patches 186 and the surrounding portions of radio-frequency opaque layers 128-1 and 128-2 may both be formed from indium tin oxide. As another example, conductive patches 186 may be formed from copper whereas the surrounding portions of radio-frequency opaque layers 128-1 and 128-2 are formed from indium tin oxide.

Slots or openings such as slots 194 may laterally separate the conductive patches 186 in first array 180 from each other. Slots or openings such as slots 195 may laterally separate the conductive patches 186 in second array 182 from each other. Slots 194 and 195 may sometimes be referred to herein as gaps, notches, or openings. Slots 194 may also separate conductive patches 186 in first array 180 from the portion of radio-frequency opaque layer 128-1 surrounding filter 140. Similarly, slots 195 may separate conductive patches 186 in second array 182 from the portion of radio-frequency opaque layer 128-2 surrounding filter 140. Slots 194 in first array 180 may be aligned with slots 195 in second array 182. Slots 194 and 195 may be arranged in a grid pattern, for example. Slots 194 may, for example, extend completely through the thickness of the conductive material in radio-frequency opaque layer 128-1 whereas slots 195 extend completely through the thickness of the conductive material in radio-frequency opaque layer 128-2. Slots 194 and 195 may be filled with dielectric material such as air, integral portions of other display layers 126, or other dielectrics.

The dimensions of slots 194 and 195 and the dimensions of conductive patches 186 (e.g., the periodicity of conductive patches 186), the materials used to form conductive patches 186, and the material used to form display layer 126 may each be selected to configure filter 140 to be transparent to radio-frequency signals at predetermined frequencies (e.g., to define the cut off frequency of filter 140 to be greater the frequencies that are handled by phased array antenna 60 of FIGS. 8 and 9).

For example, the distance 196 between conductive patches 186 in first array 180 and second array 182 (e.g., the width 196 of slots 194 and 195), the width 192 of conductive patches 186 in first array 180 and second array 182, the distance 144 between first array 180 and second array 182 (e.g., the thickness of intervening display layer 126), the material used to form display layer 126, and/or the material used to form conductive patches 186 may be selected so that filter 140 passes (transmits) a satisfactory amount of radio-frequency energy through display module 130 below a desired cutoff frequency (e.g., within a millimeter wave frequency band covered by phased array antenna 60 of FIGS. 8 and 9). These dimensions may be much less than the wavelength of operation of phased array antenna 60. For example, the sum of width 196 and width 192 may be, for example, approximately equal to one-tenth the effective wavelength of operation of phased array antenna 60 (e.g., an effective wavelength given corresponding dielectric effects associated with phased array antenna 60 and display layer 126).

As just one example, width 192 may be between 0.1 mm and 0.3 mm (e.g., approximately 200 microns), width 196 may be between 0.05 mm and 0.15 mm (e.g., approximately 100 microns), and distance 144 may be between 20 microns and 80 microns (e.g., approximately 50 microns) to provide filter 140 with a transmission coefficient that is greater than a predetermined threshold for radio-frequency signals at millimeter wave frequencies (e.g., where conductive patches 186 are formed using copper and display layer 126 has a dielectric constant of approximately 2.5). These examples are merely illustrative and may be adjusted if desired to tweak the transmission response of filter 140.

In practice, if care is not taken, slots in filter 140 may be visible to a user of device 10 when the user is viewing display 14. Visible slots may be unsightly and can reduce the aesthetic appearance of images displayed using display 14, for example. In order to mitigate these effects, the width 196 of slots 194 and 195 may be sufficiently small so as to be too narrow to be resolved by the unaided human eye. By implementing filter 140 using two stacked arrays of conductive patches 186, the capacitance of filter 140 may be increased in the direction of the Z-axis of FIG. 10 relative to scenarios where only a single array of conductive patches is used. This increase in Z-axis capacitance may allow width 196 of slots 194 and 195 to be reduced to significantly less than the wavelengths of operation of phased array antenna 60 while still allowing satisfactory transmission characteristics for the wavelengths of operation of phased array antenna 60 (e.g., a width 196 of 100 microns is significantly less than the millimeter or centimeter scale wavelength of the radio-frequency signals handled by phased array antenna 60).

This reduction in width 196 of slots 194 and 195 may reduce width 196 to below what is ordinarily resolvable by the unaided human eye at a predetermined distance from display 14 (e.g., a typical viewing distance from display 14 during operation of device 10). As an example, widths 196 that are less than 200 microns may narrower than what is resolvable by the unaided human eye at a typical viewing distance from display 14. This may allow the entirety of filter 140 and the surrounding radio-frequency opaque portion 150 of display module 130 to appear to the user as a single continuous (solid) piece of metal, thereby obscuring the potentially unsightly appearance of slots 194 and 195 from the user's view. This may serve to enhance the aesthetic properties of the images displayed by display 14 to the user.

As an example, the optical characteristics of filter 140 and radio-frequency opaque portion 150 of display module 130 may be characterized by the reflectivity, absorption, and transmission of visible light when display 14 is turned off or not emitting light. For example, filter 140 may exhibit a first reflectivity, first absorptivity, and first transmissivity, whereas opaque portion 150 of display module 130 exhibits a second reflectivity, second absorptivity, and second transmissivity for visible light when display 14 is turned off or not emitting light. In order to appear to the unaided eye as a single continuous piece of conductor, the first reflectivity, first absorptivity, and/or first transmissivity may be within a predetermined margin of the second reflectivity, second absorptivity, and/or second transmissivity, respectively (e.g., within a margin of 10%, 20%, 10-20%, 20-30%, 5%, 2%, 1-10%, etc.).

The example of FIG. 10 is merely illustrative. If desired, conductive patches 186 may have different shapes, sizes, and/or dimensions (e.g., conductive patches 186 may have any number of curved and/or straight sides). Similarly, slots 194 and 195 may follow any desired pattern of straight and/or curved paths. The conductive patches 186 in first array 180 may all have the same shape, size, and/or dimension or two or more conductive patches in first array 180 may have different shapes, sizes, and/or dimensions (as long as the conductive patches 186 in second array 180 match and align with the conductive patches 186 in second array 182). Any desired number of conductive patches 186 may be formed in arrays 180 and 182. Filter 140 may have any desired shape and dimensions. One or more display layers 126 may be interposed between first array 180 and second array 182. In another possible arrangement, arrays 180 and 182 may both be embedded within the same display layer 126 while being separated by distance 144.

The example of FIG. 10 in which filter 140 is formed from two stacked arrays of conductive patches 186 is merely illustrative. In other suitable arrangements, filter 140 may include only a single array of conductive patches (e.g., as shown in FIG. 7) or may include more than two stacked arrays of conductive patches (e.g., three stacked arrays, four stacked arrays, more than four stacked arrays, etc.). In a scenario where filter 140 includes only a single array of conductive patches, filter 140 may sometimes be referred to as a frequency selective surface (e.g., because the slots and patches in the filter would be confined to a radio-frequency opaque layer 128). In these scenarios, the width of slots 194 may be greater than in the arrangement shown in FIG. 10 to allow satisfactory transmission within the same frequency band (e.g., such that the slots may no longer be invisible to the unaided eye of the user). On the other hand, using only a single array of conductive patches may reduce the manufacturing complexity of display 14 relative to scenarios where stacked arrays are used, for example. In the arrangement of FIG. 10, filter 140 may sometimes be referred to as including two stacked frequency selective surfaces (e.g., a first frequency selective surface formed from layer 128-1 and array 180 and a second frequency selective surface formed from layer 128-2 and array 182).

Figure 11:
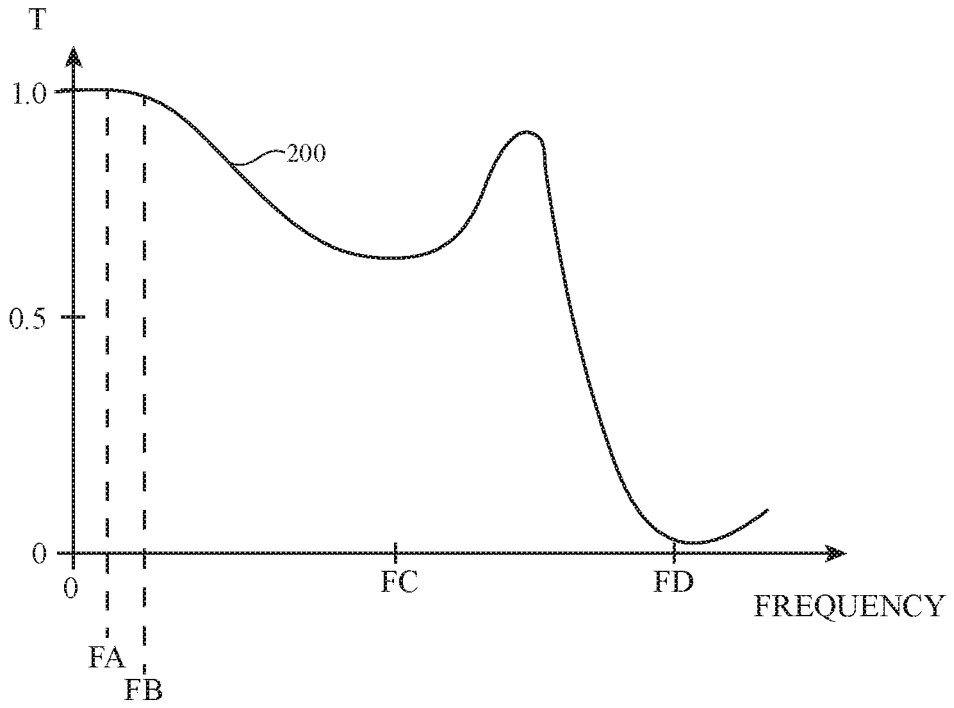
FIG. 11 is a graph of transmission as a function of frequency for a filter of the type shown in FIGS. 8 and 10 in accordance with an embodiment.

FIG. 11 is a plot of the transmission coefficient of filter 140 of FIG. 10 as a function of frequency. In particular, curve 200 illustrates the transmission coefficient T of filter 140 as a function of frequency (e.g., the proportion of radio-frequency energy that is passed through display module 130 as a function of frequency). As shown in FIG. 11, when filter 140 is formed using stacked arrays of conductive patches such as arrays 180 and 182 of FIG. 10, filter 140 serves as a low pass filter that passes radio-frequency signals below a cutoff frequency FD and that significantly attenuates (e.g., blocks) radio-frequency signals above cutoff frequency FD. Width 196 of slots 194 and 195, width 192 of conductive patches 186, the material used to form display layer 126, and the material used to form conductive patches 186 (e.g., as shown in FIG. 10) may be selected so that transmission coefficient T of filter 140 is greater than a predetermined threshold value (e.g., within a few percent of 1.0) within a frequency band of interest between frequencies FA and FB. Frequencies FA and FB may, for example, define the lower and upper limits of the frequency band of operation of phased array antenna 60 of FIG. 9. Frequency FA may be, for example, 10 GHz, 28 GHz, 30 GHz, 39 GHz, 60 GHz, or any other desired frequency greater than or equal to 10 GHz etc. Frequency FB may be, for example, 28 GHz, 30 GHz, 39 GHz, 60 GHz, 70 GHz, or any other desired frequency greater than frequency FA and less than 300 GHz. Frequency FD may be, for example, any desired frequency greater than frequency FB such as 300 GHz (e.g., filter 140 may block signals at frequencies greater than 300 GHz).

When configured in this way, filter 140 may be effectively transparent to radio-frequency signals conveyed by phased array antenna 60 while also including slots 194 and 195 that are too narrow to be resolved by the unaided human eye at a typical viewing distance from display 14. In this way, filter 140 may serve as a radio-frequency transparent antenna window in display module 130 without substantially affecting the quality of images displayed using display 14. In the example of FIG. 11, transmission curve 200 also exhibits a peak between frequency FC and cutoff frequency FD associated with the resonance of the conductive structures and slots in filter 140 (e.g., the filter may be non-resonant at the frequency of operation of phased array antenna 60 but resonant at frequencies greater than those handled by phased array antenna 60 such as around 400 GHz). This is merely illustrative and, in general, curve 200 may have any desired shape (e.g., as determined by the configuration of the conductive patches 186 and the material properties of display layer 126 in filter 140).

Figure 12:
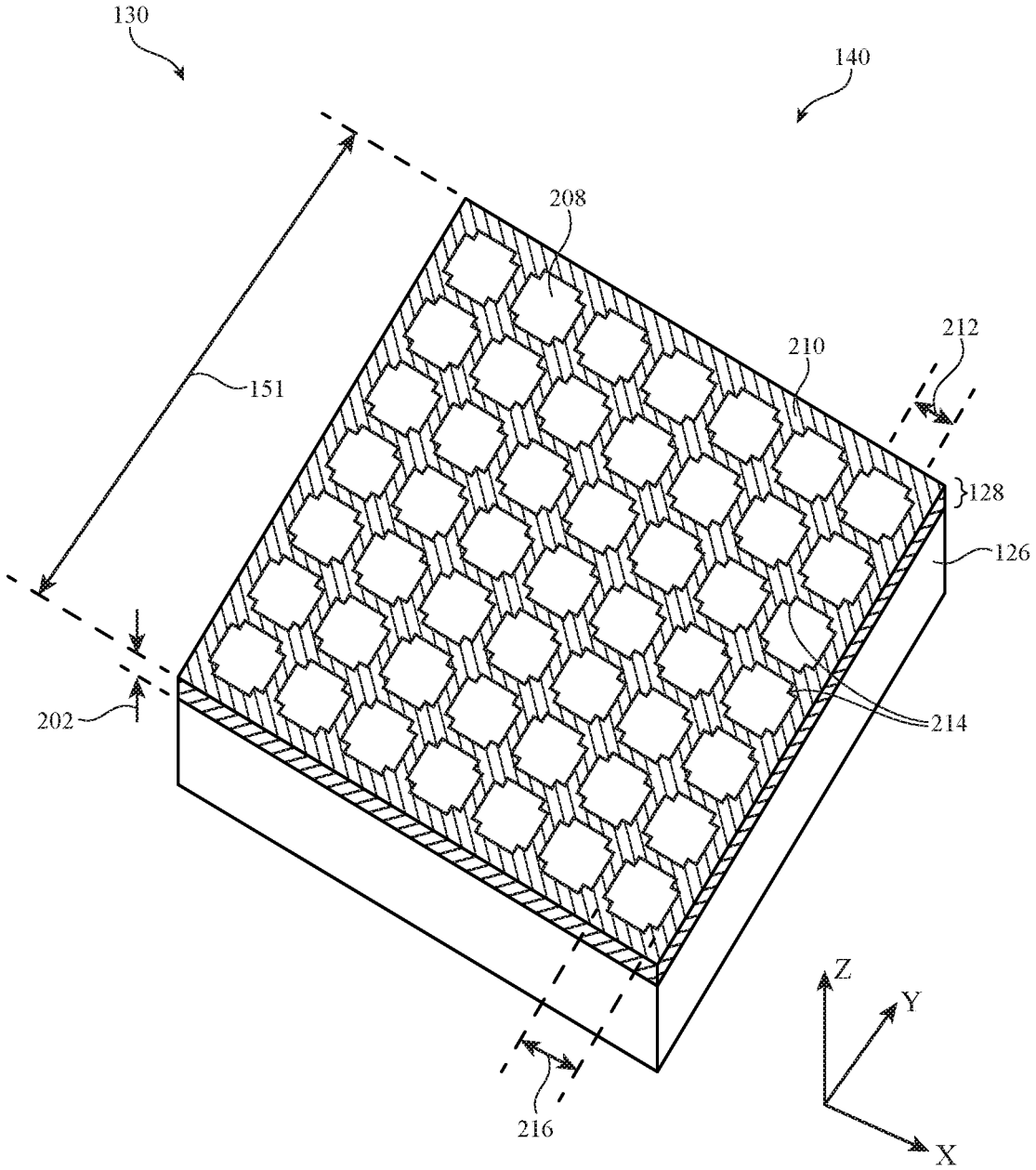
FIG. 12 is a perspective view of an illustrative filter formed from inductive paths within a conductive layer in a display in accordance with an embodiment.

If desired, filter 140 may be implemented using inductive paths in a given radio-frequency opaque layer 128 of display module 130. FIG. 12 is a perspective view of one suitable arrangement for filter 140 in which filter 140 includes a single layer of conductive structures that form inductive paths in a corresponding radio-frequency opaque layer 128 (e.g., a radio-frequency opaque layer 128 as shown in FIG. 7).

As shown in FIG. 12, filter 140 may include a pattern of slots 208 (sometimes referred to as notches, gaps, openings, or holes 208) formed in radio-frequency opaque layer 128. Each slot 208 may be completely surrounded by conductive material from radio-frequency opaque layer 128. The conductive material surrounding slots 208 may form inductive paths 210 (sometimes referred to herein as conductive paths 210) on a surface of an underlying display layer 126.

Slots 208 may, for example, be arranged in an array. Conductive paths 210 may be arranged in a grid pattern defining the edges of slots 208. Radio-frequency opaque portion 150 of display module 130 (as shown in FIGS. 7 and 9) may be formed from a portion of radio-frequency opaque layer 128 laterally surrounding filter 140 on the top surface of display layer 126 and is not shown in FIG. 12 for the sake of clarity. Other display layers above and below filter 140 in display module 130 are also omitted from FIG. 12 for the sake of clarity.

As shown in FIG. 12, filter 140 may extend across length 151 of display module 130. Conductive paths 210 may be formed from metal traces on display layer 126, from metal foil, or any other desired conductive structure. Conductive paths 210 may be formed, for example, from copper, aluminum, stainless steel, silver, gold, nickel, tin, indium tin oxide, other metals or metal alloys, or any other desired conductive materials. Conductive paths 210 may be formed from the same material as the surrounding portions of radio-frequency opaque layer 128 (e.g., the portion of layer 128 forming radio-frequency opaque portion 150 of display module 130 as shown in FIG. 9) or may be formed from a different material from the surrounding portions of radio-frequency opaque layer 128. As an example, conductive paths 210 and the surrounding portions of radio-frequency opaque layer 128 may both be formed from indium tin oxide or conductive paths 210 may be formed from copper whereas the surrounding portions of radio-frequency opaque layer 128 are formed from indium tin oxide.

Slots 208 may, for example, extend completely through the thickness of radio-frequency opaque layer 128 (e.g., as shown in FIG. 7). Slots 208 may be filled with dielectric material, with an integral portion of the underlying display layer 126, or may be void of material. Conductive paths 210 (e.g., radio-frequency opaque layer 128) may have a thickness 202.

The dimensions of slots 208 may be selected to adjust the inductance of conductive paths 210 and to tweak the transmission characteristics of filter 140. More particularly, the dimensions of slots 208, the materials used to form conductive paths 210, and the material used to form display layer 126 may be selected to configure filter 140 to be transparent to radio-frequency signals at predetermined frequencies (e.g., to define the pass band of filter 140 to overlap with frequencies greater than 10 GHz that are handled by phased array antenna 60 of FIGS. 7 and 9). If desired, conductive paths 210 may include conductive tabs 214 that extend into slots 208 to tweak the inductance of conductive paths 210 and the overall area of slots 208. The presence of conductive tabs 214 may allow the shape of slots 208 to be characterized by an inner width 212 (e.g., the distance between adjacent conductive tabs 214) and an outer width 216 (e.g., the distance between opposing ends of slot 208).

Inner width 212, outer width 216, thickness 202 of radio-frequency opaque layer 128, the material used to form display layer 126, and the material used to form conductive paths 210 may be selected so that filter 140 transmits a satisfactory amount of radio-frequency energy through display module 130 within a desired pass band (e.g., a pass band overlapping a millimeter wave frequency band covered by phased array antenna 60 of FIG. 9). As just one example, inner width 212 may be between 1.0 mm and 2.0 mm (e.g., approximately 1.4 mm), outer width 216 may be between 2.0 mm and 2.5 mm (e.g., approximately 2.3 mm), and thickness 202 may be between 0.2 mm and 0.5 mm to provide filter 140 with a transmission coefficient that is greater than a predetermined threshold for radio-frequency signals at millimeter wave frequencies. These examples are merely illustrative and may be adjusted if desired to tweak the transmission response of filter 140.

The dimensions of slots 208 (e.g., widths 212 and 216) are much greater than 200 microns and therefore could be visible to a user of device 10 when viewing display 14. However, while forming filter 140 using conductive paths 210 as shown in FIG. 12 sacrifices display aesthetics relative to the stacked arrays of conductive patches as shown in FIG. 10, forming filter 140 using conductive paths 210 may be easier and less expensive to manufacture relative to the arrangement of FIG. 10, for example. Filter 140 may exhibit a satisfactory radiation pattern envelope such as pattern envelope 160 of FIG. 9 that covers substantially all of the hemisphere above display 14 regardless of whether conductive paths 210 (e.g., as shown in FIGS. 7 and 12) or one or more arrays of conductive patches 186 (e.g., as shown in FIGS. 7, 8, and 10) are used to form filter 140.

The example of FIG. 12 is merely illustrative. If desired, slots 208 may have different shapes, sizes, and/or dimensions (e.g., slots 208 may have any number of curved and/or straight sides). Similarly, slots 208 may be arranged in any desired pattern and need not be arranged in a grid of rows and columns. Conductive paths 210 may follow any desired pattern and may have straight and/or curved edges. Slots 208 in filter 140 may all have the same shape, size, and/or dimension or two or more slots 208 in filter 140 may have different shapes, sizes, and/or dimensions. Any desired number of slots 208 may be formed in filter 140. Filter 140 may have any desired shape and dimensions. Because conductive paths 210 and slots 208 are limited to a single radio-frequency opaque layer 128 in display module 130, conductive paths 210 and slots 208 (i.e., filter 140 when configured as shown in FIG. 12) may form a frequency selective surface.

Figure 13:
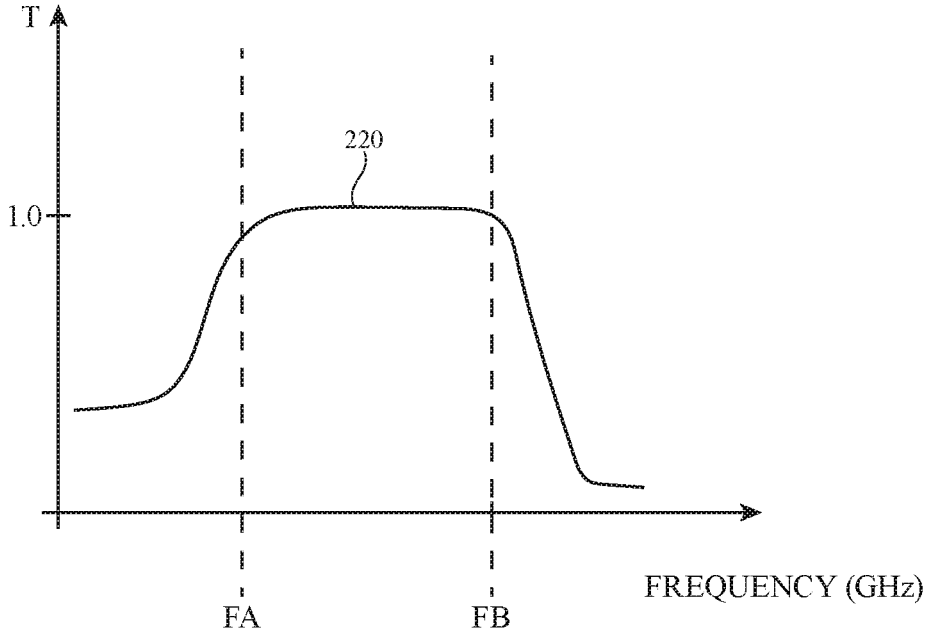
FIG. 13 is a graph of transmission as a function of frequency for a filter of the type shown in FIG. 12 in accordance with an embodiment.

FIG. 13 is a plot of the transmission coefficient of the filter having conductive paths 210 and slots 208 of FIG. 12 as a function of frequency. In particular, curve 220 illustrates the transmission coefficient T of filter 140 of FIG. 12 as a function of frequency. As shown in FIG. 13, when filter 140 is formed using conductive paths 210 and slots 208, filter 140 serves as a band pass filter that passes radio-frequency signals between a first cutoff frequency FA and a second cutoff frequency FB and that significantly attenuates (blocks) radio-frequency signals above cutoff frequency FB and below cutoff frequency FA. The dimensions of slots 208 and conductive paths 210, the material used to form display layer 126, the material used to form conductive paths 210, and thickness 202 of layer 128 (e.g., as shown in FIG. 12) may be selected so that transmission coefficient T of filter 140 is greater than a predetermined threshold value (e.g., within a few percent of 1.0) within a frequency band of interest between frequencies FA and FB. Frequencies FA and FB may, for example, define the lower and upper limits of the frequency band of operation of phased array antenna 60 of FIG. 9 or may be lower than and greater than the limits of the frequency band of operation of phased array antenna 60 by a predetermined margin (e.g., frequencies FA and FB may define the pass band of filter 140 of FIG. 12). Frequency FA may be, for example, 10 GHz, 28 GHz, 30 GHz, 39 GHz, 60 GHz, or any other desired frequency greater than or equal to 10 GHz etc. Frequency FB may be, for example, 28 GHz, 30 GHz, 39 GHz, 60 GHz, 70 GHz, or any other desired frequency greater than frequency FA and less than 300 GHz. In this way, filter 140 may serve as a radio-frequency transparent antenna window in display module 130 for phased array antenna 60. The example of FIG. 13 is merely illustrative and, in general, curve 220 may have any desired shape (e.g., as determined by the configuration of the conductive paths 210 and slots 208 and the material properties of display layer 126 in filter 140 of FIG. 12).

The foregoing is merely illustrative and various modifications can be made to the described embodiments. The foregoing embodiments may be implemented individually or in any combination.

What is claimed is:

1. An electronic device comprising:

a display cover layer;

a display module configured to emit light through the display cover layer, wherein the display module comprises a conductive layer; and a filter in the conductive layer, wherein the filter is configured to pass electromagnetic signals within a frequency band, the frequency band comprises a frequency between 10 GHz and 300 GHz, and the filter is configured to block electromagnetic signals outside of the frequency band.

2. The electronic device defined in claim 1, wherein the conductive layer comprises a portion that is opaque to electromagnetic signals at the frequency and that laterally surrounds at least one side of the filter.

3. The electronic device defined in claim 2, further comprising:

a phased array antenna aligned with the filter and configured to transmit radio-frequency signals at the frequency through the display module via the filter.

4. The electronic device defined in claim 2, wherein the portion of the conductive layer that is opaque to electromagnetic signals at the frequency comprises pixel circuitry for the display module.

5. The electronic device defined in claim 2, wherein the portion of the conductive layer that is opaque to electromagnetic signals at the frequency comprises touch sensor electrodes for the display module that are configured to gather a touch input through the display cover layer.

6. The electronic device defined in claim 1, wherein the conductive layer comprises indium tin oxide.

7. The electronic device defined in claim 1, wherein the electronic device comprises a wristwatch.

8. The electronic device defined in claim 1, wherein the filter comprises a frequency selective surface.

9. The electronic device defined in claim 1, further comprising:

a housing, wherein the display cover layer is mounted to the housing.

10. The electronic device defined in claim 1, further comprising an antenna aligned with the filter, wherein the antenna is configured to transmit and receive, through the filter, radio-frequency signals at the frequency.

11. The electronic device defined in claim 1, wherein the filter comprises conductive patches that are separated by slots in the conductive layer.

12. The electronic device defined in claim 11, wherein the display module comprises an additional conductive layer and a dielectric layer that is interposed between the conductive layer and the additional conductive layer.

13. The electronic device defined in claim 12, wherein the filter comprises additional conductive patches in the additional conductive layer that are separated by additional slots in the additional conductive layer, and the additional conductive patches in the additional conductive layer are aligned with the conductive patches in the conductive layer.

14. The electronic device defined in claim 12, wherein the slots in the conductive layer have a width that is less than 200 microns.

15. An electronic device comprising:

a display cover layer;

a display module configured to emit light through the display cover layer, wherein the display module comprises a conductive layer;

an antenna configured to transmit radio-frequency signals at a frequency between 10 GHz and 300 GHz; and a filter in the conductive layer, wherein the filter is configured to pass the radio-frequency signals transmitted by the antenna.

16. The electronic device defined in claim 15, wherein the frequency is in a frequency band and the filter is configured to block electromagnetic signals outside of the frequency band.

17. The electronic device defined in claim 15, wherein the filter comprises conductive patches separated by slots in the conductive layer.

18. The electronic device defined in claim 15, wherein the antenna is configured to receive, through the filter, radio-frequency signals at the frequency.

19. A wristwatch comprising:

a housing;

a display having a display cover layer mounted to the housing and having a display module configured to display images through the display cover layer, wherein the display module comprises a conductive layer;

a filter in the conductive layer, wherein the filter is configured to pass electromagnetic signals within a frequency band, the frequency band comprises a frequency between 10 GHz and 300 GHz, and the filter is configured to block electromagnetic signals outside of the frequency band; and an antenna configured to transmit radio-frequency signals at the frequency through the filter.

20. The wristwatch defined in claim 19, wherein the antenna is configured to receive, through the filter, radio-frequency signals at the frequency.

* * * * *